US010465972B2

(12) United States Patent
Hasegawa et al.

(10) Patent No.: US 10,465,972 B2
(45) Date of Patent: Nov. 5, 2019

(54) CONTAINER AND REFRIGERATOR

(71) Applicant: SHARP KABUSHIKI KAISHA, Sakai, Osaka (JP)

(72) Inventors: Yuya Hasegawa, Sakai (JP); Yohei Morita, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/080,289

(22) PCT Filed: Feb. 27, 2017

(86) PCT No.: PCT/JP2017/007297
§ 371 (c)(1),
(2) Date: Aug. 27, 2018

(87) PCT Pub. No.: WO2017/187754
PCT Pub. Date: Nov. 2, 2017

(65) Prior Publication Data

US 2019/0072318 A1 Mar. 7, 2019

(30) Foreign Application Priority Data

Apr. 26, 2016 (JP) ..... 2016-088256
Apr. 26, 2016 (JP) ..... 2016-088301

(51) Int. Cl.
*F25D 23/04* (2006.01)
*B65D 1/24* (2006.01)
(Continued)

(52) U.S. Cl.
CPC ..... *F25D 23/04* (2013.01); *B65D 1/24* (2013.01); *F25D 23/028* (2013.01);
(Continued)

(58) Field of Classification Search
CPC ..... F25D 23/04; F25D 25/02; F25D 25/005; F25D 25/022; F25D 2331/803; A47B 96/16
See application file for complete search history.

(56) References Cited

U.S. PATENT DOCUMENTS 4,859,010 A * 8/1989 Jeziorowski ..... A47B 57/10 312/321.5
6,231,146 B1 5/2001 Dang
6,997,526 B2 * 2/2006 Leimkuehler ..... F25D 23/04 312/321.5

FOREIGN PATENT DOCUMENTS

JP H08-170873 A 7/1996
JP H11-237173 A 8/1999
(Continued)

OTHER PUBLICATIONS

JP2005016900A Translated Description (Year: 2005).*
JP2007183073A Translated Description (Year: 2007).*
JP2015038410A Translated Description (Year: 2015).*

*Primary Examiner* — Andrew M Roersma
(74) *Attorney, Agent, or Firm* — ScienBiziP, P.C.

(57) ABSTRACT

A container (10) has a plurality of storage spaces arranged in rows. The container (10) is installable on the inner side of a door (11*a*) of a refrigerator (1). The storage space of the frontmost row is shallower than at least one of the storage spaces of back rows when the container (10) is installed on the door (11*a*). The refrigerator (1) includes a refrigeration compartment (1), and a door (11*a*) installed on the refrigeration compartment (1). At least one container (10) is installed on the inner side of the door (11*a*).

13 Claims, 16 Drawing Sheets

(51) Int. Cl.
*F25D 23/02* (2006.01)
*F25D 25/00* (2006.01)
*F25D 25/02* (2006.01)

(52) U.S. Cl.
CPC ..... *F25D 25/005* (2013.01); *F25D 25/02* (2013.01); *F25D 2323/021* (2013.01); *F25D 2331/803* (2013.01)

(56) References Cited

FOREIGN PATENT DOCUMENTS

| | | | | | | |
|---|---|---|---|---|---|---|
| JP | 2001280837 | A | * | 10/2001 | ..... | F25D 23/04 |
| JP | 2002-347794 | A | | 12/2002 | | |
| JP | 2005-016900 | A | | 1/2005 | | |
| JP | 3872018 | B2 | * | 1/2007 | ..... | F25D 23/04 |
| JP | 2007-120909 | A | | 5/2007 | | |
| JP | 2007-183073 | A | | 7/2007 | | |
| JP | 2009-041866 | A | | 2/2009 | | |
| JP | 2012-026639 | A | | 2/2012 | | |
| JP | 5191706 | B2 | * | 5/2013 | ..... | F25D 23/04 |
| JP | 2014238218 | A | * | 12/2014 | ..... | F25D 23/04 |
| JP | 2015-038410 | A | | 2/2015 | | |
| JP | 2015094508 | A | * | 5/2015 | ..... | F25D 23/04 |
| WO | WO-2017033475 | A1 | * | 3/2017 | ..... | F25D 23/04 |

* cited by examiner

CONTAINER AND REFRIGERATOR

TECHNICAL FIELD

The present invention relates to a container for storing articles. The invention also relates to a container that is installable on a door of a refrigerator.

BACKGROUND ART

The inner side of a door of a refrigerator is typically equipped with a container for storing tubes and bottles of food products such as seasonings.

For example, PTL 1 discloses a food container for refrigerators that is sized to fit an inner chamber of a refrigerator side by side. The food container for refrigerators is substantially rectangular in shape when viewed in plan, and is vertically long with a height greater than the width of the rectangular shape of the container so that the container can fit an inner chamber of a refrigerator side by side. The food container also has an upper opening through which a food product is taken in and out of the container, and at least a cold air vent formed at the bottom of the container.

PTL 2 discloses a refrigerator provided with a tube storing means. The refrigerator includes a door for opening and closing a front opening of a refrigerator main body; a first door container and a second door container vertically disposed on the inner side of the door; and a tube storing means installable in the first door container or in the second door container. The tube storing means has a first stopper and a second stopper respectively provided on a longer side and a shorter side of the tube storing means. The first door container is taller than the second door container. The first stopper is provided at such a height that the first stopper engages the front wall of the first door container. The second stopper is provided at such a height that the second stopper engages the front wall of the second door container.

CITATION LIST

Patent Literature

PTL 1: JP-A-8-170873
PTL 2: JP-2-2012-26639
PTL 3: JP-A-2007-183073

SUMMARY OF INVENTION

Technical Problem

However, providing a container on the inner side of a refrigerator door may limit the storage space inside a refrigerator, depending on the shape of the container.

PTL 3 discloses tilting a storage pocket, and disposing at least a part of the bottom surface of a front pocket below the bottom surface of a rear pocket so as to make it easier to take out the stored article. However, a drawback of such storage pockets provided on the door of a refrigeration compartment is that the article stored in the frontmost pocket may protrude from the storage pocket, and collide with the adjacent door, or with the inner wall of the refrigerator.

For more efficient use of the storage space inside the refrigerator, attempts are made to provide a detachable container that can be detached from a door of a refrigerator, and placed on other locations, particularly for storage of seasoning tubes and bottles. Possible locations include, for example, a shelf inside a refrigeration compartment, a table outside of the refrigerator, and a cooking kitchen counter. For this purpose, the container needs have the versatility to adapt to various such locations.

In one aspect of the invention, the invention is intended to improve user convenience with a container having plural rows of storage spaces. In another aspect, the invention is intended to provide a container that enables effective use of the space on the inner side of a refrigeration compartment door while reducing the possibility of a stored article colliding with other parts of the refrigerator when opening and closing the door.

Solution to Problem

According to an aspect of the present invention, there is provided a container comprising a plurality of storage spaces arranged in rows, wherein the storage space lying in the frontmost row is shallower than at least one of the storage spaces of back rows.

A container according to another aspect of the present invention may be such that the plurality of storage spaces represents three storage spaces, in which the storage space lying in the middle row is the deepest of the three storage spaces, and in which a width between outer edges surrounding the three storage spaces is the smallest for the storage space of the front row, and is the largest for the storage space of the back row.

In some aspect of the present invention, the container may be such that the container when placed on a surface tilts a storage direction of the storage spaces with respect to the surface on which the container is placed, the container has a center of gravity vertically above a first placement surface that contacts a horizontal surface when the container is placed on the horizontal surface with the storage space of the back row facing down, and the container has a center of gravity vertically above a second placement surface that contacts a horizontal surface when the container is placed on the horizontal surface with the storage space of the front row facing down.

In some aspect of the present invention, the container may be such that the tilt angle of the storage direction of the storage spaces is larger when the container lies on the first placement surface than when the container lies on the second placement surface.

In some aspect of the present invention, the container may include reinforcing ribs having vertically extending surfaces projecting out from both side surfaces of the container.

In some aspect of the present invention, the container may include partition walls between the storage spaces, and at least one of the partition walls may have a step.

In some aspect of the present invention, the container may be installable on an inner wall surface of a door of a storage.

In some aspect of the present invention, the container may be such that the storage space of the back row on the side opposite the hinged side of the door is separated from the outer edges surrounding the plurality of storage spaces.

In some aspect of the present invention, the container may include a plurality of storage spaces that is disposed in depth direction and that tilts forward and upward when the container is installed on the door, and the storage space of the frontmost row may be narrower in the depth direction than at least one of the storage spaces of back rows.

In some aspect of the present invention, a side wall that projects out toward a storage chamber may be provided on at least the open end side on the inner side of the door, and the container may further include engaging portions that engage stoppers provided on the door, and reinforcing members that are provided in front of the engaging portions and that contact the side walls when the container is installed on the door.

In some aspect of the present invention, the container may be such that the engaging portions are disposed behind the both side surfaces of the container, and that the container includes a protrusion formed on a back portion of the container to join the engaging portions disposed on the both sides of the container.

In some aspect of the present invention, the container may be such that a partition wall is disposed between the adjacent storage spaces in the plurality of storage spaces, and that an end of the partition wall may be separated from a side portion on the open end side of the door.

In some aspect of the present invention, the container may be such that a partition wall is disposed between the storage space of the rearmost row and the adjacent storage space in the plurality of storage spaces, and that the partition wall on the open end side of the door has a bent end portion that is bent toward the rearmost row.

According to another aspect of the present invention, there is provided a refrigerator that includes:

a refrigeration compartment; and a door installed on the refrigeration compartment, wherein any of the containers above is installed on an inner side of the door.

Advantageous Effects of Invention

As stated above, the container of an aspect of the present invention has enabled further improvement in the convenience of a user using a container having plural rows of storage spaces.

In the container according to an aspect of the present invention, the middle row is the deepest of the three rows, and the container can be used with the storage spaces being tilted with respect to a surface on which the container is placed. The container also can be stably placed, regardless of whether which row of the storage spaces is on the bottom. The container can thus be placed in various places, and the convenience improves.

Because the width between the outer edges gradually increases from the front row to the back row, a user can choose to decide which side—the front row or the back row—is on the bottom, according to the way the user wishes to use the container.

In the container according to an aspect of the present invention, the storage spaces are tilted forward, and the storage space of the frontmost row is shallower than at least one of the storage spaces of back rows. When used by being installed on a door of a storage, the container thus allows effective use of the space on the inner side of the door, without greatly affecting other parts of the storage.

DESCRIPTION OF EMBODIMENTS

Figure 1:
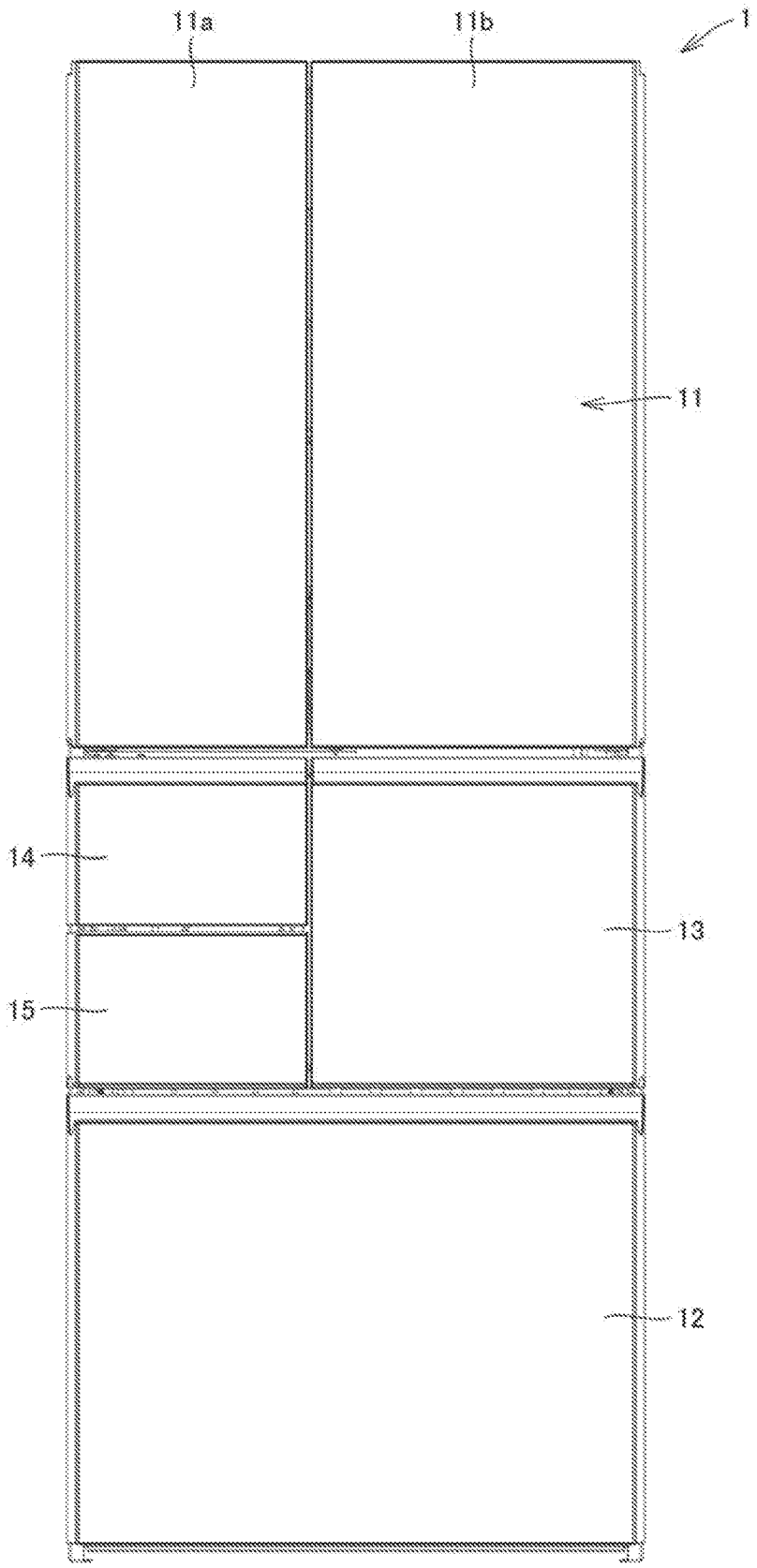
FIG. 1 is an external elevational view of a refrigerator according to First Embodiment of the present invention.

Embodiments of the present invention are described below with reference to the accompanying drawings. In the following descriptions, like elements are given like reference numerals. Such like elements will be referred to by the same names, and have the same functions. Accordingly, detailed descriptions of such elements will not be repeated.

First Embodiment

First Embodiment describes an exemplary structure in which a container of an aspect of the present invention is installed on the inner side of a door of a refrigerator. The present invention, however, is limited to this configuration. For example, a container of an aspect of the present invention may be installed on a door of a storage (storehouse) other than refrigerators.

Overall Configuration of Refrigerator

FIG. 1 shows a schematic structure of a refrigerator 1 according to the present embodiment. As illustrated in FIG. 1, the refrigerator 1 includes a refrigeration compartment 11 disposed in the uppermost stage, and a first freezer 12 disposed in the lowermost stage. In the middle stage of the refrigerator 1, a second refrigeration compartment 13 is disposed on the right, and an ice compartment 14 and a second freezer 15 are disposed on the upper left and the lower left, respectively.

In the present embodiment, the front of the refrigerator is the side where the door is provided. The top, the sides, the back, and the bottom of the refrigerator 1 are with respect to the front side of the refrigerator as defined above when the refrigerator 1 is installed in a normal fashion. Accordingly, the terms "front side" and "back side" as used herein define a given location with respect to the front or the back of the refrigerator, or a direction toward the front or the back of the refrigerator. In this specification, the term "depth direction" is used to refer to a direction from the back side to the front side of the refrigerator, or a direction from the front side to the back side of the refrigerator.

An openable and closable door is provided on the front of each storage room of the refrigerator 1. For example, in the present embodiment, the first refrigeration compartment (storage chamber) 11 has a double refrigeration compartment door (a left refrigeration compartment door 11*a*, and a right refrigeration compartment door 11*b*). The left refrigeration compartment door 11*a* is slightly smaller in size than the right refrigeration compartment door 11*b*. Though not illustrated, the first freezer 12, the second refrigeration compartment 13, the ice compartment 14, and the second freezer 15 have other types of doors, for example, drawer-type doors.

The door configuration in the refrigerator of an aspect of the present invention is not limited no the foregoing configurations. The doors of the storage compartments may be appropriately selected from, for example, a double door, a left- or right-hinged door, a double-hinged door, and a drawer door according to factors such as the structure, the use, and the position of the storage compartment.

Figure 2:
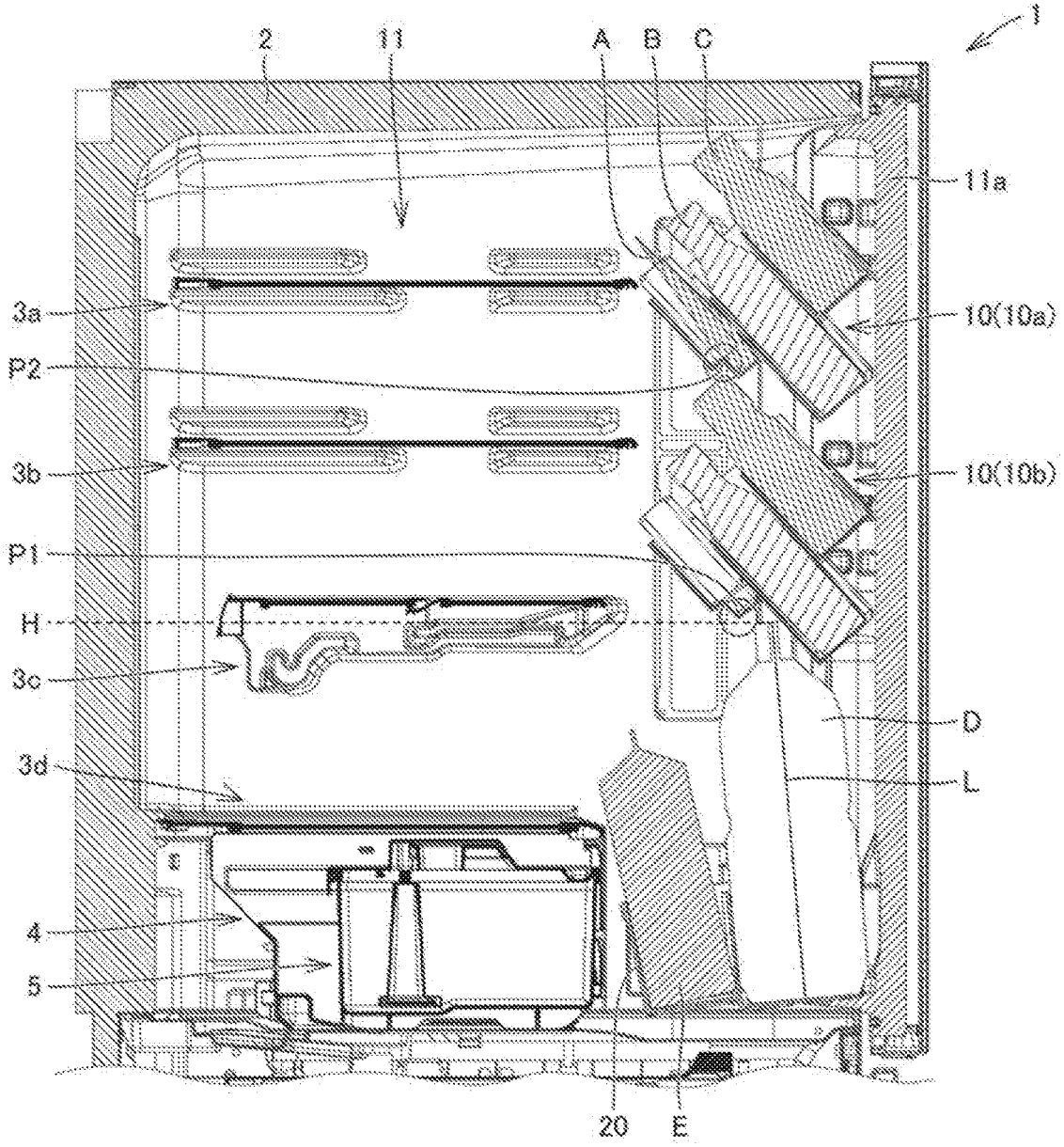
FIG. 2 is a cross sectional view showing a configuration inside a refrigeration compartment of the refrigerator illustrated in FIG. 1.

FIG. 2 shows a cross section of a configuration inside the first refrigeration compartment 11. The refrigeration compartment 11 is surrounded by walls of an adiabatic housing 2. Inside the refrigeration compartment 11 are provided a plurality of partition shelves 3*a*, 3*b*, 3*c*, and 3*d*, a chiller case 4, and a water tank 5 that supplies water for ice making, among others. Detachable containers 10 are installed at the top and middle on the inner side (the refrigeration compartment. 11 side) of the left refrigeration compartment door 11*a*. A container 20 intended for storage of large beverage containers such as plastic bottles D and large paper cartons E is installed at the bottom on the inner side of the left refrigeration compartment door 11*a*.

The two containers 10 installed at the top and the middle of the refrigeration compartment door 11*a* are the same. For the sake of explanation, the upper container will be referred to as container 10*a*, and the lower container will be referred to as container 10*b*. As illustrated in FIG. 2, the container 10 has three storage spaces that are arranged in rows in depth direction. These storage spaces are storing articles A, B, and C of different sizes and heights, for example, bottles, plastic containers (plastic bottles), and tube-like containers.

Configuration of Container

Figure 7:
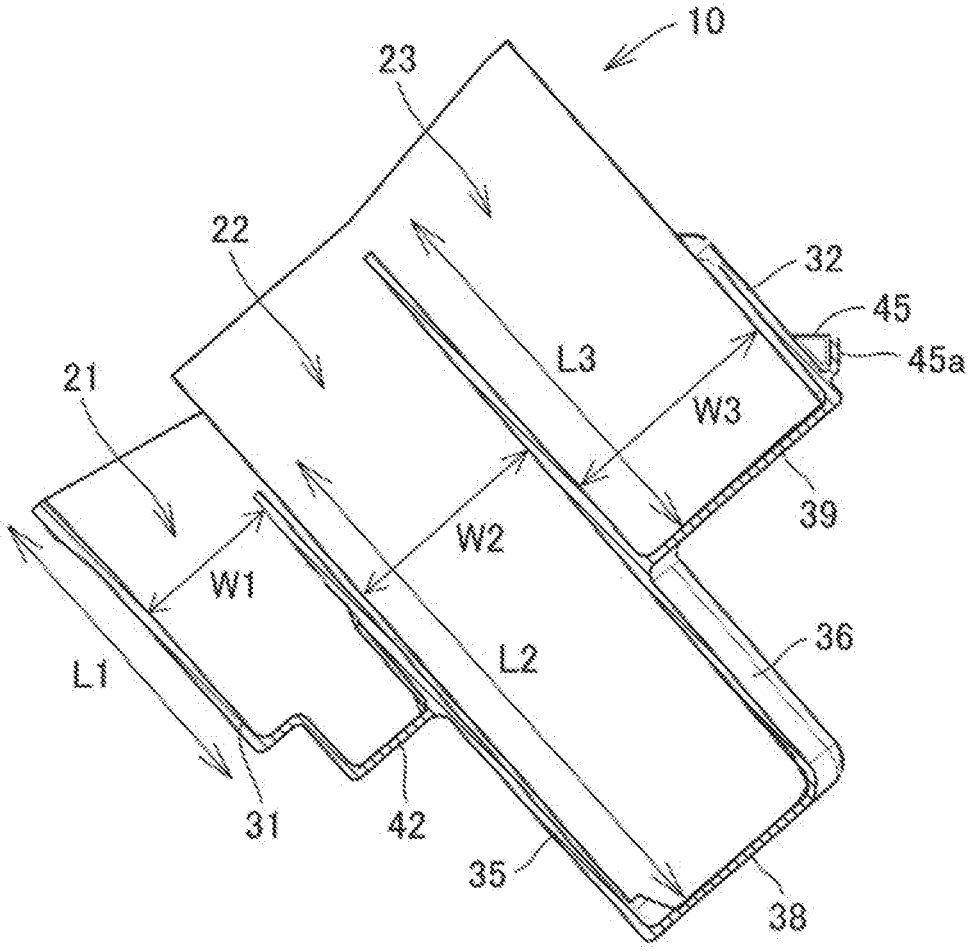
FIG. 7 is a cross sectional view schematically illustrating a configuration of the container shown in FIG. 3.

The configuration of the container 10 is described below in detail, with reference to FIGS. 3 to 7. FIGS. 3 to 6 are diagrams showing multi-angle views of the container 10 removed from the refrigeration compartment door 11*a*. FIG. 7 is a cross sectional view of the container 10 taken at the broken line of FIG. 3.

Figure 3:
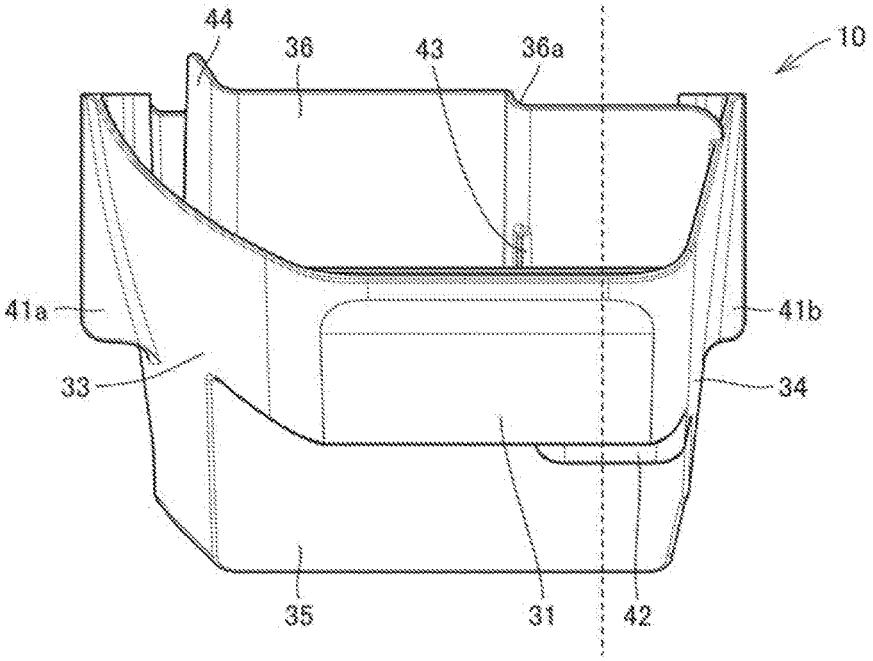
FIG. 3 is a front perspective view of a container to be installed in the refrigerator according to First Embodiment of the present invention.

For the sake of explanation, the side of the container 10 facing the front in FIG. 3 is the front side of the container 10, and the outer surface of the container 10 on the front side is the front surface of the container 10. The other surfaces of the container 10 are specified with respect to the front surface of the container 10 defined above. For example, the outer surface of the container 10 opposite the front side is the back surface (rear surface) of the container 10. The term. "depth direction" will be used to refer to a direction from the back side to the front side of the container 10, or a direction from the front side to the back side of the container 10.

As illustrated in the figures, the outer shape of the container 10 is configured mainly from a front portion 31, a back portion. 32, a left side portion (a side portion, an outer edge) 33, a right side portion 34 (an outer edge), a first partition wall 35, a second partition wall 36, and bottom portions 37, 38, and 39. The container 10 has three storage spaces 21, 22, and 23 that are arranged in rows in depth direction. The number of storage spaces, which is three in the present embodiment, is not limited to three in the container of an aspect of the present invention. Preferably, the container according to ah aspect of the present invention has more than one row of storage spaces in depth direction. In this way, relatively small articles can be disposed side by side in rows.

The storage space 21 (a front storage space) in the frontmost row (the farthest from the back of the refrigeration compartment door 11*a*) is configured mainly from the front portion 31, the first partition wall 35, and the bottom portion 37. The storage space 21 has depth L1 (see FIG. 7). In the present embodiment, the bottom portion 37 at the right end of the storage space 21 has a raised portion 42. The raised portion 42 of the storage space 21 is deeper than depth ml other portions of the storage space 21.

Figure 4:
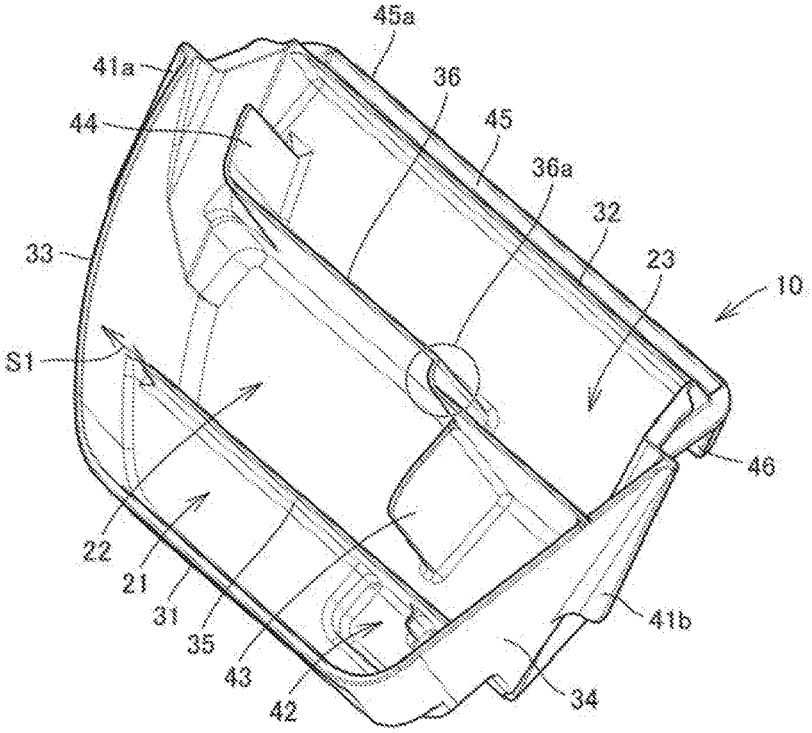
FIG. 4 is a top perspective view of a container to be installed in the refrigerator according to First Embodiment of the present invention.

The storage space 22 in the middle row is configured mainly from the first partition wall 35, the second partition wall 36, and the bottom portion 38. The storage space 22 has depth L2 (see FIG. 7). As illustrated in FIG. 4, the storage space 22 is further divided into two parts by a third partition wall 43. The third partition wall 43 is provided as a vertical wall substantially perpendicular to the surface of the second partition wall 36.

The storage space 23 in the rearmost row (a back storage space) is configured mainly from the second partition wall 36, the back portion 32, and the bottom portion 39. The storage space 23 has depth L3 (see FIG. 7).

Figure 5:
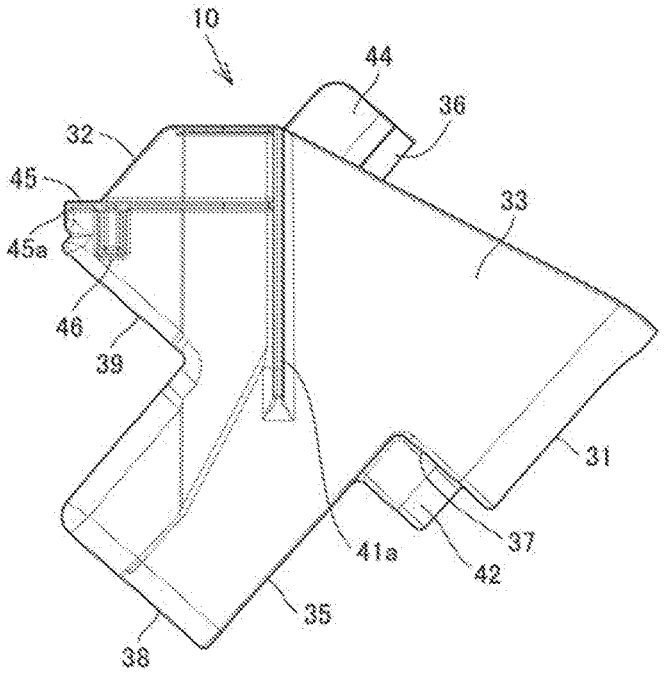
FIG. 5 is a side view of a container to be installed in the refrigerator according to First Embodiment of the present invention.
Figure 6:
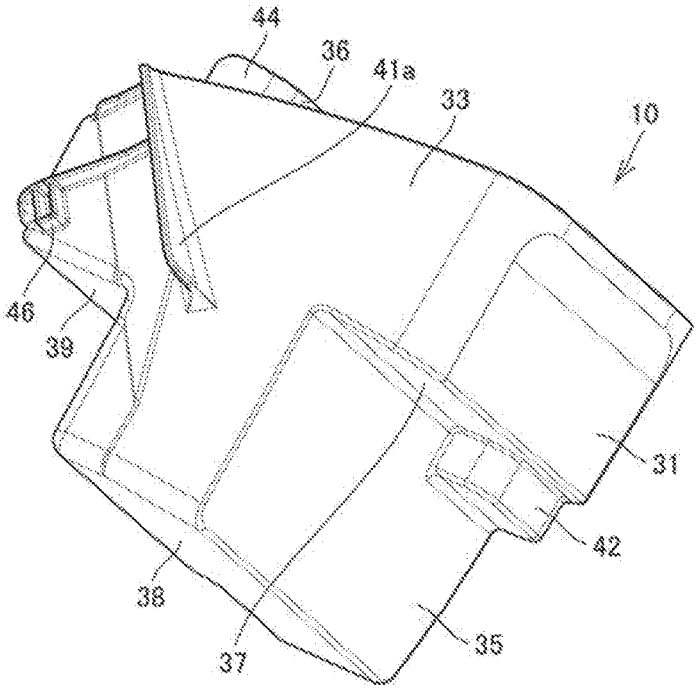
FIG. 6 is a bottom perspective view of a container to be installed in the refrigerator according to First Embodiment of the present invention.

As illustrated in FIG. 5, the bottom portions 37, 38, and 39 of the storage spaces 21, 22, and 23 are at different levels. That is, the bottom portion of the container 10 is stepped. Accordingly, the depths L1, L2, and L3 of the storage spaces 21, 22, and 23 are different. The depth L2 of the storage space 22 in the middle row of the container 10 is the largest. In other words, the container 10 is shaped so that the bottom portion 38 of the storage space 22 projects out downwardly.

As illustrated in FIG. 4, the widths Wa, Wb, and Wc between the outer edges of the storage spaces 21, 22, and 23 of the container 10 (the distance from the left side portion 33 to the right side portion 34) are related to one another by the following relationship.

$$Wa<Wb<Wc$$

That is, the outer edges (the left side portion 33 and the right side portion 34) surrounding the three rows of storage spaces 21, 22, and 23 gradually become wider from, the storage space 21 of the first row toward the storage space 23 in the back row.

With this configuration, the storage space 23 having the largest width contacts the wall side of the refrigeration compartment door 11*a*. This makes it possible to spread the pressure on the wall of the door, and reduce deformation in the wall of the door. Because the storage space 21 of the smallest width is on the outer side where the turning radius of the door is large, it is also possible to reduce collisions between the container 10 and other members when the door is turning.

The storage spaces 21, 22, and 23 of the container 10 are configured so that these storage spaces tilt forward and upward when installed on the refrigeration compartment door 11*a*. In this way, the articles stored in the storage spaces also tilt forward, and this makes it easier to take out the stored articles. When the stored article is tilted, the top of the stored article projects out of the container, and may collide with the other refrigeration compartment door 11*b* when opening and closing the refrigeration compartment door 11*a*. The container 10 circumvents this by making the depth L1 of the storage space 21 of the frontmost row smaller than the depth L1 of the storage space 22 of the adjacent middle row lying behind the storage space 21. Because a tall article cannot be stably stored in the storage space 21 of the frontmost row, a user would choose to store a tall article in the storage space 22 or 23 of the back rows. The articles stored in the storage space 21 of the frontmost row are thus more likely to be relatively shorter articles, and do not project out of the container as much as when taller articles are stored in the storage space 21.

Because the storage spaces 21, 22, and 23 have different depths L1, L2, and L3, articles of different heights can be disposed in whichever of the storage spaces of a depth that suits the stored article. The relationship between the depth L1 of the storage space 21 of the frontmost row, and the depth L3 of the storage space 23 of the rearmost row is not particularly limited. For example, the depth L1 of the storage space 21 of the frontmost row may be the smallest as in the container 10 of the present embodiment. In this case, the bottom portion 37 of the storage space 21 can be raised in position (P1 and P2 in FIG. 2). In this way, when the containers 10*a* and 10*b* are installed at the top and the middle of the refrigeration compartment door 11*a* as in FIG. 2, the stored article in the lower container can be more easily taken in and out of the container.

Preferably, the widths (depths) W1, W2, and W3 of the storage spaces 21, 22, and 23 in depth direction (see FIG. 7) are also different. In this way, articles of different sizes can be disposed in whichever of the storage spaces of a width that suits the stored article.

For example, the width W1 of the storage space 21 of the frontmost row is preferably smaller than the width W2 of the storage space 22 of the middle row. In this way, the widths W1 and W2 of the storages spaces 21 and 22 can have the same relationship as the depths L1 and L2 of the storage spaces 21 and 22. This makes the storage space 21 generally more suitable for storage of smaller articles, whereas the storage space 22 can be provided as a storage space that is generally more suited for storage of larger articles. Because an article with a large bottom surface is less likely to be stored in the storage space 21 of the frontmost row, protrusion of the stored article in the frontmost row can be more reliably prevented. The relationship between the width W1 of the storage space 21 of the frontmost row, and the width W3 of the storage space 23 of the rearmost row is not particularly limited. For example, the width W1 of the storage space 21 of the frontmost row may be the smallest as in the container 10 of the present embodiment.

The second partition wall 36 has a stepped portion 36*a* formed near the base of the third partition wall 43. With the stepped portion 36*a*, the sizes of the storage spaces 22 and 23 divided by the second partition wall 36 can be varied at the stepped portion 36*a*. This makes it possible to provide these storage spaces in sizes that are more suited for articles of different sizes.

As illustrated in FIG. 4, while the right end of the first partition wall 35 is joined to the right side portion 34, the left end of the first partition wall 35 is not joined to the left side portion 33. That is, a space S1 is provided between the left end of the first partition wall 35 and the left side portion 33. With the provision of the space S1, the stored article at the left end of the storage space 21 can have some room to escape when opening and closing the refrigeration compartment door 11*a*, as will be described later. This makes it possible to prevent the stored article at the left end of the storage space 21 from colliding with the open end of the right refrigeration compartment door 11*b*, or to reduce the impact of an accidental collision when opening and closing the refrigeration compartment door 11*a*.

As illustrated in FIG. 4, the second partition wall 36 has a right end portion 44 that is bent backward (toward the storage space 23). The right end of the second partition wall 36 is separated from the left side portion 33 with some distance. With the bent end portion 44, the stored article at the left end of the storage space 22 can have some room to escape when opening and closing the refrigeration compartment door 11*a*, as will be described later. This makes it possible to prevent the stored article at the left end of the storage space 22 from colliding with the open end of the right refrigeration compartment door 11*b*, or to reduce the impact of an accidental collision when opening and closing the refrigeration compartment door 11*a*.

Figure 8:
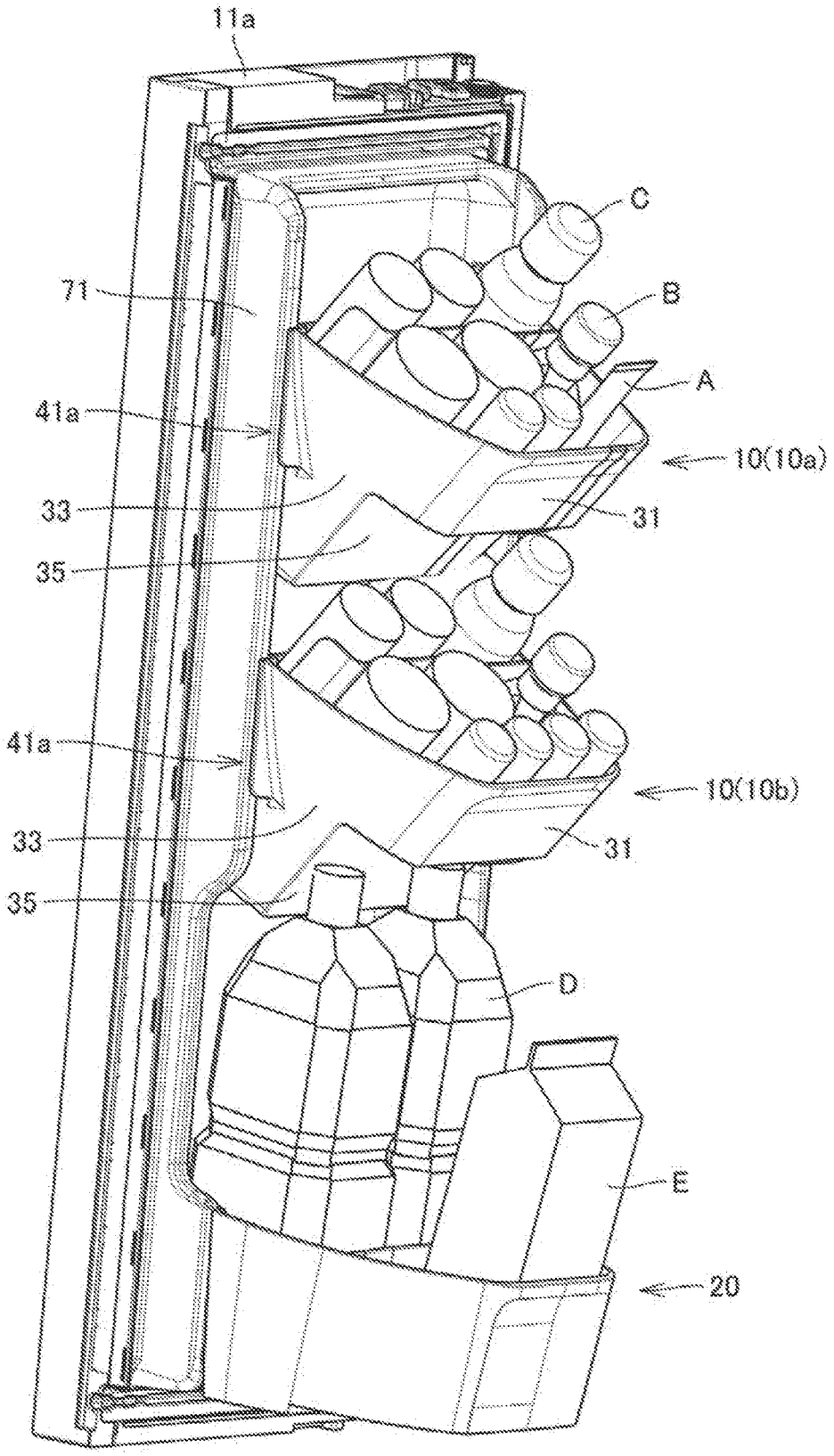
FIG. 8 is a perspective view showing the inner side of a refrigeration compartment door of the refrigerator shown in FIG. 1, representing a state in which articles are stored in the container installed on the refrigeration compartment door.

When, for example, a tall article such as the article C shown in FIG. 8 is stored in the storage space 23 on the open end side of the refrigeration compartment door 11*a* (the right end in FIG. 10), the article has a possibility of running off the predetermined radius R. However, by the provision of the bent end portion 44, the article stored in the storage space 23 can be prevented from colliding with the open end of the right refrigeration compartment door 11*b*.

As described above, the left end of the first partition wall 35, and the left end of the second partition wall 36 are preferably separated from the left side portion 33. By not joining these partition walls to the left side portion 33, it is possible to reduce the generation of sink marks and unevenness on a molded surface when molding the container 10 with resin. This makes it possible to provide a smooth outer surface in the left side portion 33. Separating the end portions of the partition walls from the left side portion 33 can also improve the design of the container 10 when forming the container 10 with a transparent material.

A small, groove-like space 45 for storing smaller articles is formed on the back of the container 10. The small-article storage space 45 is intended for storage of, for example, cartons of condiments such as wasabi and ginger, and cartons of seasonings such as sauce and soy sauce.

Hooks (engaging portions) 46 for attachment to the refrigeration compartment door 11*a* are provided at the left and right ends of the small-article storage space 45. The hooks are fitted to the grooves (stoppers) formed in the refrigeration compartment door 11*a*. This fixes the container 10 to the refrigeration compartment door 11*a*. The hooks 46 and the grooves (stoppers) are formed in such positions that the container 10 can be stably fixed to the refrigeration compartment door 11*a*. For example, the hooks 46 may be formed behind the left and right side portions 33 and 34 (see FIGS. 4 and 5, and elsewhere). The grooves (stoppers) to be fitted to the hooks 46 may be formed in side walls 71 of the refrigeration compartment door 11*a*.

The left side portion 33 and the right side portion 34 of the container 10 have reinforcing ribs (reinforcing members) 41*a* and 41*b*, respectively. The reinforcing ribs 41*a* and 41*b* are shaped so that these members contact the side walls 71 of the refrigeration compartment door 11*a* upon installing the container 10 on one refrigeration compartment door 11*a* (see FIG. 8). With the reinforcing ribs 41*a* and 41*b*, the container 10 can be more stably fixed to the refrigeration compartment door 11*a*. The strength can improve when the end portions of the reinforcing ribs 41*a* and 41*b* are bent.

The weight of the stored articles on the container 10 can spread by fixing the container 10 to the refrigeration compartment door 11*a* with the hooks 46 and the reinforcing ribs 41*a* and 41*b*. The stored article tends to move the center of gravity of the container 10 forward when the storage spaces are tilted forward. This creates a downward torque about the hooks 46. However, because the reinforcing ribs 41*a* and 41*b* are in contact with the side walls 71 of the refrigeration compartment door 11*a*, the side walls 71 of the refrigeration compartment door 11*a* can receive and spread the torque with their top surfaces. This makes it possible to reduce deformation or damaging of the refrigeration compartment door 11*a* and the container 10 as might occur when the stress locally concentrates on the side walls 71 of the refrigeration compartment door 11*a*, or on the container 10.

As illustrated in FIG. 4, the small-article storage space 45 is formed by a protrusion 45*a* that joins the left and right hooks 46. By the provision of the protrusion 45*a*, the strength of the main body of the container 10, and the strength of the hooks 46 can improve.

Configuration of Refrigeration Compartment Door with Container

Figure 9:
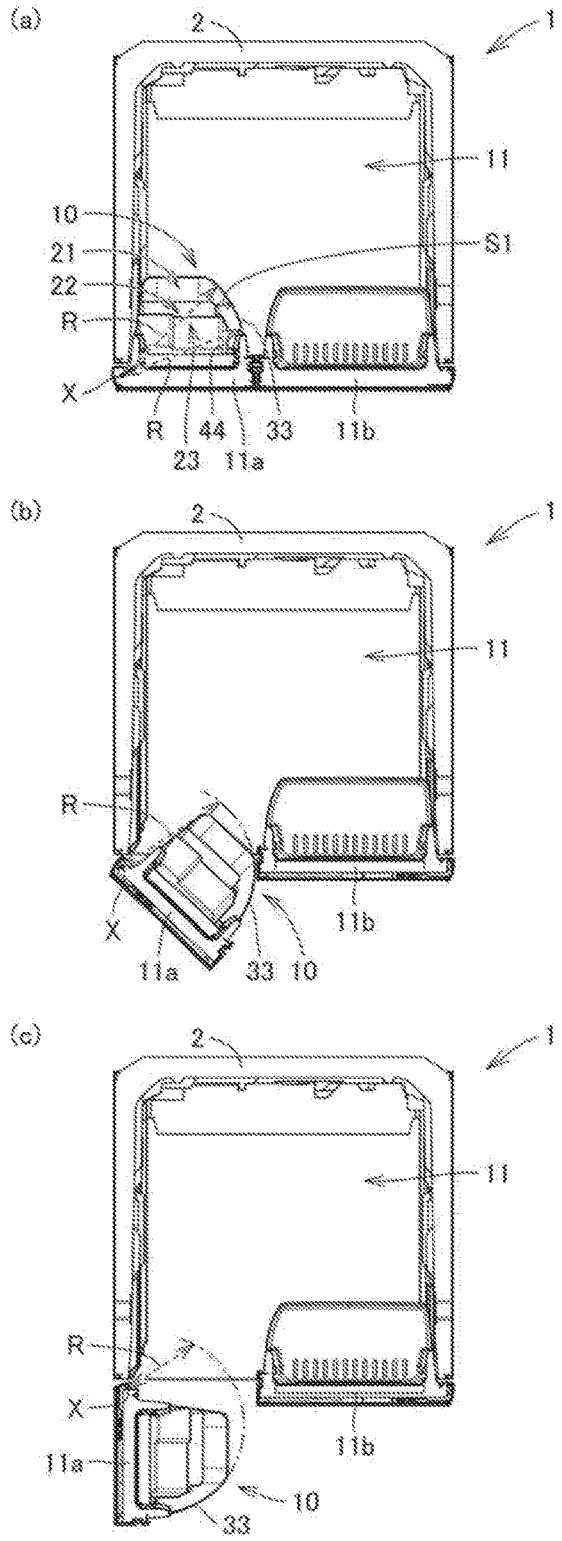
FIGS. 9 (*a*) to (*c*) are cross sectional views of the refrigerator shown in FIG. 1, in which (a) shows the refrigerator with the refrigeration compartment door closed, (b) shows the refrigerator with the refrigeration compartment door open with an about 45 degree angle, and (c) shows the refrigerator with the refrigeration compartment door open with an about 90 degree angle.
Figure 10:
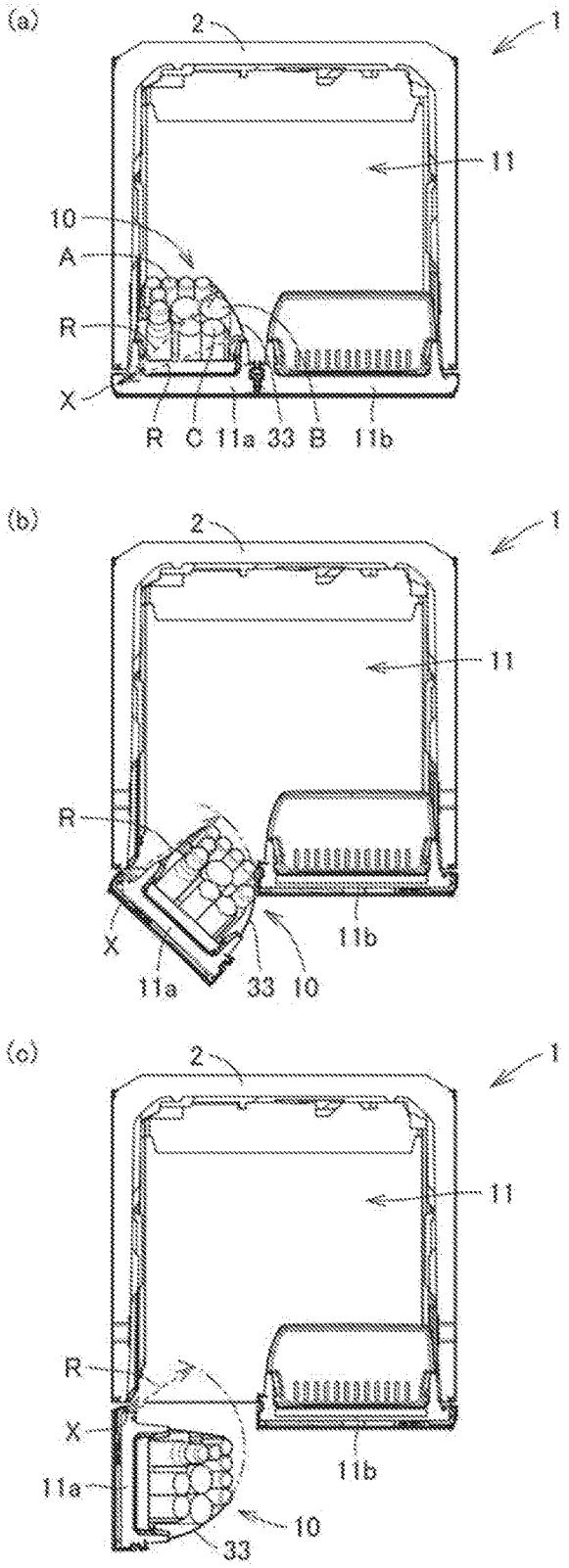
FIGS. 10 (*a*) to (*c*) are cross sectional views of the refrigerator storing articles in the containers, corresponding to FIGS. 9 (*a*) to (*c*), respectively.

The following describes the configuration of the refrigeration compartment door 11*a* with the container 10 installed thereon, and the open/close operation of the refrigeration compartment door 11*a*, with reference to FIGS. 8 to 10. FIG. 8 shows the inner side of the refrigeration compartment door 11*a*. In FIG. 8, the open end side of the refrigeration compartment door 11*a* appears in the front. FIGS. 9 and 10 show how the refrigeration compartment door 11*a* changes its state from a closed state to an open state in (a) to (c).

As illustrated in FIG. 8, the container 10*a*, the container 10*b*, and a large container 20 are installed on the inner side (back side) of the refrigeration compartment door 11*a*, as shown in this order from the top. The containers 10*a* and 10*b* have the same configuration as the container 10 described above.

The side walls 71 are disposed near the left and right ends on the back side of the refrigeration compartment door 11*a*, projecting out from the back of the door, and extending along the ends of the door. The containers 10*a*, 10*b*, and 20 are fitted between the left and right side walls 71. The reinforcing ribs 41*a* and 41*b* formed on the left side portion 33 and the right side portion 34 of the containers 10*a* and 10*b* are in contact with the top of the side walls 71 of the refrigeration compartment door 11*a*.

As illustrated in FIG. 8, relatively tall articles, such as a large plastic bottle D, and a large paper carton F are disposed in the container 20 installed in the bottom stage of the refrigeration compartment door 11*a*. The container 20 has essentially the same configuration as containers installed in traditional refrigerator doors.

For example, small- to middle-sized plastic bottles and glass bottles, cylindrical containers, and tube-like containers are disposed in the containers 10*a* and 10*b* installed in the top and the middle stage of the refrigeration compartment door 11*a*. The container 10 has three rows of storage spaces in depth direction, as described above. The storage spaces 21, 22, and 23 have different depths. It is therefore preferable that articles A, B, C be disposed in the storage spaces 21, 22, and 23 of depths and widths that match these articles in the container installed in the refrigeration compartment door 11*a*.

For example, article B, such as a relatively tall middle-sized bottle, and a cylindrical container should be disposed in the deepest storage space 22 of the middle row. Article C, which is not as large as article B and not as small as article A, should be disposed in the storage space 23 of an intermediate depth provided in the rearmost row.

Article A, such as a relatively short small cylindrical container, should be disposed in the shallowest storage space 21 of the frontmost row. The storage space 21 has the raised portion 42 formed in a portion of the bottom portion 37. The portion of the storage space 21 where the raised portion 42 is formed is deeper than other portions of the storage space 21. Desirably, narrow articles, such as a tube-like container, should be disposed in the raised portion 42 of the storage space 21.

As illustrated in FIGS. 2 and 8, the container 10 is configured so that the storage spaces 21, 22, and 23, when installed on the refrigeration compartment door 11*a*, tilt with respect to a horizontal surface. In this way, taller articles can be disposed in the container of the refrigeration compartment door 11*a* as compared to a traditional container having storage spaces that are perpendicular to a horizontal surface. Because the storage spaces 21, 22, and 23 are tilted with respect to a horizontal surface, it is also possible to make effective use of the space on the inner side of the refrigeration compartment door 11*a*.

Because the storage space 21 of the frontmost row is the smallest, a space is created in front of the first partition wall 35 of the container 10, as shown in FIG. 8. This makes it possible to provide a wider space between the container 10*a* and the container 10*b*, and between the container 10*b* and the container 20 when the container 10*a*, the container 10*b*, and the container 20 are installed as shown in the figure.

This configuration allows taller articles to be stored in the storage space 23 provided in the rearmost row of the container 10, or in the rear storage space of the container 20. The space created in front of the first partition wall 35, and the tilting of the storage space 23 with respect to a horizontal surface also make it easier to take out the articles stored in the back rows, as illustrated in FIG. 2.

Preferably, the container 10*b* disposed in the middle stage, and the container 20 disposed in the bottom stage have the following positional relationship. Specifically, the height H at which the normal line L from the center of the bottom surface of the back storage space of the container 20 crosses the first partition wall 35 of the container is preferably lower than the lowermost point P1 of the storage space 21 of the middle container 10*b* (see FIG. 2). This makes it even easier to take out the stored article from the container 20. It is also possible to create a larger storage capacity (height in particular) in the back row of the bottom container 20.

The container 10 according to the present embodiment is installed on the left door of the double refrigeration compartment door. Accordingly, the side surface (i.e., the left side portion 33) of the container 10 on the open end side of the left refrigeration compartment door is curved.

More specifically, the left side portion 33 of the container 10 has a curved surface (outer surface) along the arc (shown in dashed-dotted line in FIG. 9) of a predetermined radius R around the center of rotation X of the refrigeration compartment door 11*a* undergoing an open/close operation (see FIG. 9). In this way, the left side portion 33 can be prevented from contacting other parts of the refrigerator 1 when opening and closing the refrigeration compartment door 11*a*. The length of radius R may be, for example, about several centimeters shorter than the distance from the center of rotation X of the refrigeration compartment door 11*a* to the open end of the refrigeration compartment door 11*a*.

FIG. 10 represents movement of the refrigeration compartment door 11*a* with articles A, B, and C stored in the container 10. Because the container 10 has the configuration described above, the refrigeration compartment door 11*a* can open and close in such a manner that the articles A, B, and C stored in the storage spaces of the container 10 are substantially within the predetermined radius R from the center of rotation X in the open/close operation of the refrigeration compartment door 11*a*.

Depending on the height, the stored article on the left side portion 33 side of the storage space 21 in the frontmost row of the container 10 may contact other parts of the refrigerator, for example, the open end of the refrigeration compartment door 11*b*, when opening and closing the refrigeration compartment door 11*a*.

As a countermeasure, the container 10 according to the present embodiment has the space S1 between the left end portion of the first partition wall 35 and the left side portion 33. In this way, the stored article on the left side portion 33 side of the storage space 21 can move toward the space S1 when the article accidentally contacts other parts of the refrigerator, for example, the open end of the refrigeration compartment door 11*b* in the open/close operation of the refrigeration compartment door 11*a*. This reduces the impact of contact, and damage can be prevented in the stored article, and in parts of the refrigerator 1.

Likewise, depending on the height, the stored article on the left side portion 33 side of the storage space 22 in the middle row of the container 10 may contact other parts of the refrigerator, for example, the open end of the refrigeration compartment door 11*b*, when opening and closing the refrigeration compartment door 11*a*.

As a countermeasure, in the container 10 according to the present embodiment, the second partition wall 36 has the end portion 44 that is bent backward (toward the storage space 23). In this way, the stored article on the left side portion 33 side of the storage space 22 can move back along the shape of the end portion 44 when the article accidentally contacts other parts of the refrigerator, for example, the open end of the refrigeration compartment door 11*b* in the open/close operation of the refrigeration compartment door 11*a*. This reduces the impact of contact, and damage can be prevented in the stored article, and in parts of the refrigerator 1.

As described above, in the container 10 according to the present embodiment, the side surface (i.e., the left side portion 33) on the open end side of the left refrigeration compartment door 11*a* has an arc-shape of a predetermined radius R. However, the container according to the aspect of the present invention is not limited to this configuration, provided that the side portion of the container on the open end side of the door has a curved surface that does not contact other parts of the refrigerator when the door is opened and closed with the container installed in the refrigerator.

For example, it is preferable to change the sides of the container 10 of the present embodiment when the aspect of the present invention is adopted to install the container 10 on the right refrigeration compartment door 11*b*. In the case where the refrigerator has a double door, the container may be curved in the both (right and left) side portions.

With the container having the configuration described above, a larger storage space can be created on the inner side of the door of the refrigerator. This makes it possible to make more effective use of the storage space inside the refrigerator.

A problem with a traditional container installed in a refrigerator is the difficulty in taking out the articles stored in the back storage spaces when the container installed on the inner side of a refrigerator door has more than one row of storage spaces that are arranged from the front to the back of the container. In other words, it is not necessarily user friendly to provide more than one row of storage spaces from the front to the back of a container used by being installed in a refrigerator.

In contrast, in the container according to the present embodiment, the storage space lying in the middle row is the deepest of the three storage spaces that are disposed in rows. Accordingly, the bottom surface of the storage space of the frontmost row is higher in position than the bottom surface of the storage space of the middle row. This creates a space underneath the front side of the container, and makes it easier to take an article in and out of the lower container when the containers are vertically disposed. The present embodiment can thus improve the convenience of the user using the container.

As described above, the container 10 according to the present embodiment has the three storage spaces 21, 22, and 23 that are arranged in rows. The storage space 22 of the middle row is the deepest of the three storage spaces 21, 22, and 23. That is, as illustrated in FIG. 7, the bottom portion 38 of the storage space 22 protrudes farthest downwardly.

This makes it possible to stably place the container 10 also on a flat surface, as will be described below in Second Embodiment. Here, the storage spaces 21, 22, and 23 tilt with respect to the surface on which the container 10 is placed. This makes it easier to take the store articles in and out of the container 10. The container 10 can be stably placed, regardless of whether the lower side is the storage space 21 or the storage space 23.

Variations of Container

Figure 11:
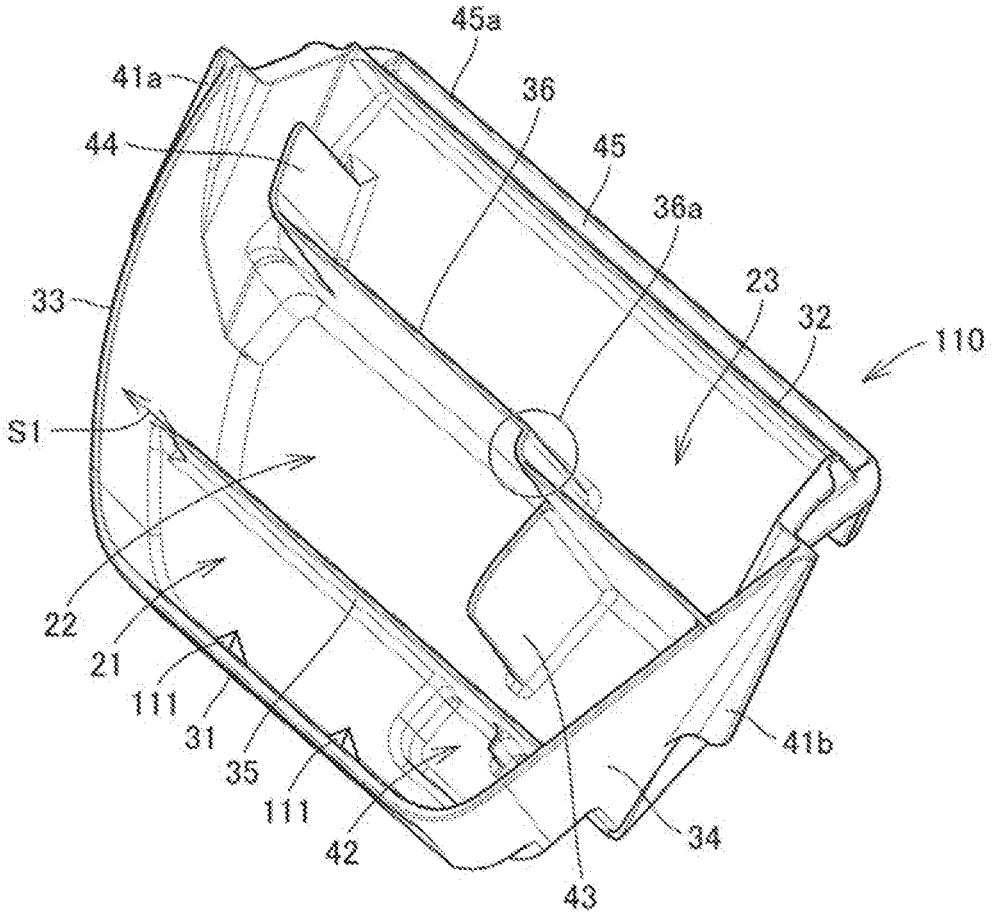
FIG. 11 is a top perspective view showing a variation of the container shown in FIG. 3.

The following describes variations of the container 10. FIG. 11 shows a container 110 according to a first variation.

Figure 12:
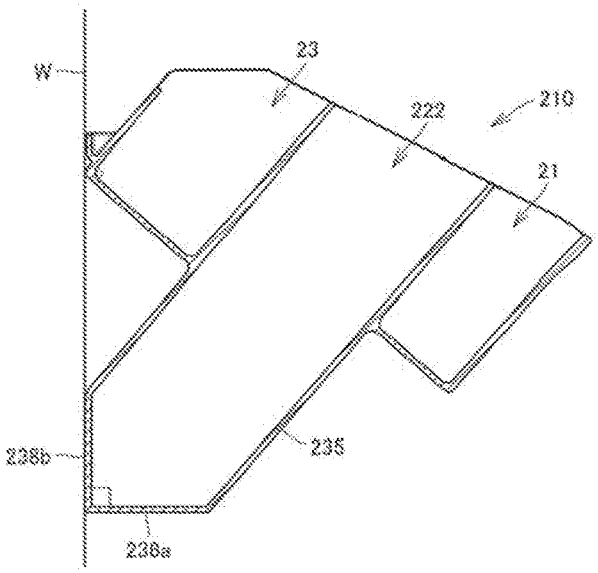
FIG. 12 is a side cross sectional view of a variation of the container shown in FIG. 3.
Figure 13:
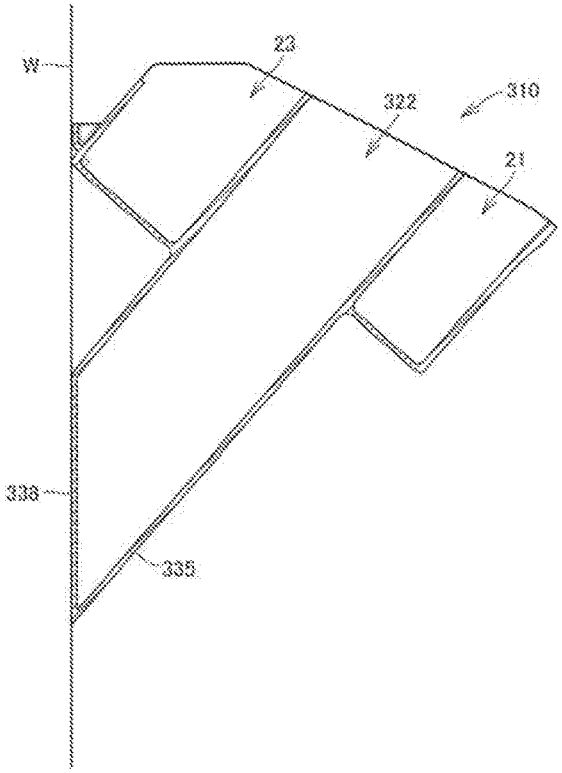
FIG. 13 is a side cross sectional view of a variation of the container shown in FIG. 3.

FIG. 12 shows a container 210 according to a second variation. FIG. 13 shows a container 310 according to a third variation.

The container 110 shown in FIG. 11 has two projections 111 formed on the front portion 31 in the storage space 21 of the frontmost row. The other configuration is the same as in the container 10. By the provision of the projections 111, the stored articles in the storage space 21 can be prevented from rolling sideways when opening and closing the refrigeration compartment door 11*a*.

In the container 110, the projections 111 are provided in the storage space 21 of the frontmost row. However, the same or similar projections may be provided in the other storage spaces 22 and 23. In the container 110, the projections 111 are provided on the front inner wall of the storage space 21.

FIG. 12 is a cross sectional view of the container 210 according to a second variation. FIG. 12 shows the container 210 installed on a wall W (for example, refrigeration compartment door 11*a*) substantially perpendicular to ground.

The container 210 differs from the container 10 in the shape of the bottom portion of the storage space 222 of the middle row. The other configuration is the same as in the container 10. As illustrated in FIG. 12, the bottom portion of the storage space 222 is formed by a first bottom portion 238*a* and a second bottom portion 238*b*.

The first bottom portion 238*a* and the second bottom portion 238*b* are joined to each other in an about 90 degree angle. The second bottom portion 238*b* is disposed in contact with the wall W when, for example, the container 210 is installed on a wall surface such as the back surface of the refrigeration compartment door 11*a*. Accordingly, the first bottom portion 238*a* is substantially horizontal (i.e., substantially perpendicular to the wall W).

With the container 210 of the configuration described above, even taller articles can be stably stored in the storage space 222 of the middle row. The container 210 also allows effective use of the space on the back surface of the refrigeration compartment door 11*a*.

FIG. 13 is a cross sectional view of the container 310 according to a third variation. FIG. 13 shows the container 310 installed on a wall W (for example, the refrigeration compartment door 11*a*) substantially perpendicular to ground.

The container 310 differs from the container 10 in the shape of the bottom portion of the storage space 322 of the middle row. The other configuration is the same as in container 10. As illustrated in FIG. 13, the storage space 322 has a bottom portion 338. The bottom portion 338 is disposed in contact with the wall W when, for example, the container 310 is installed on a wall surface such as the back surface of the refrigeration compartment door 11*a*. The first partition wall 335 and the bottom portion 338 are joined to each other in an acute angle.

With the container 310 of the configuration described above, even taller articles can be stably stored in the storage space 322 of the middle row. The storage space 322 is particularly suited for the storage of tall articles having a tapered end. The container 310 also allows effective use of the space on the back surface of the refrigeration compartment door 11*a*.

Second Embodiment

Second Embodiment of the present invention is described below. First Embodiment described an example in which the container 10 is used by being installed on the refrigeration compartment door 11*a*. However, the container of an aspect of the present invention is not limited to this use. The present embodiment describes an example in which the container is placed on a flat surface, such as the partition shelves 3*a*, 3*b*, 3*c*, and 3*d* (see FIG. 2) inside the refrigeration compartment.

Figure 14:
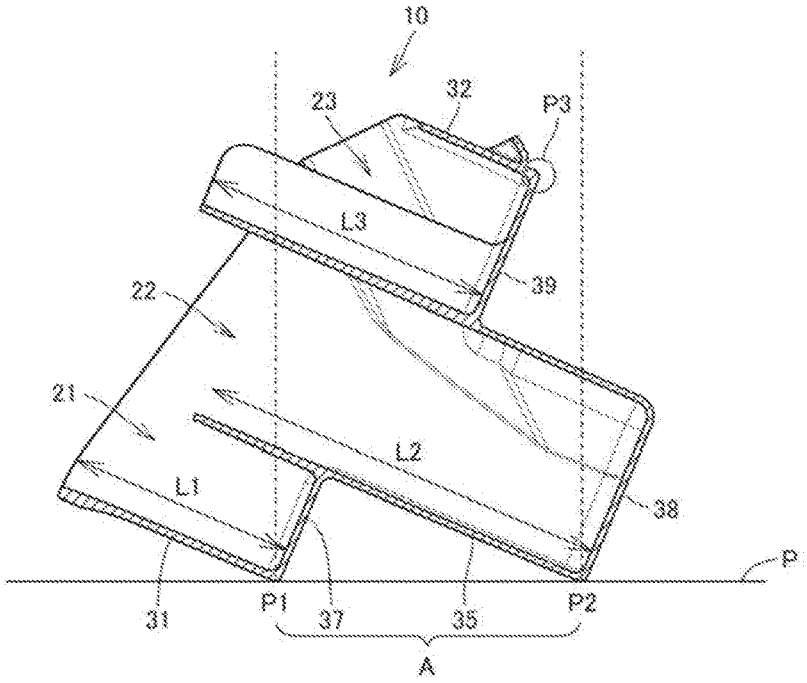
FIG. 14 is a side view schematically showing a container according to Second Embodiment of the present invention.

FIG. 14 shows the container 10 according to the present embodiment placed on a flat surface (placement surface) P. The container 10 itself may have the same configuration as described in First Embodiment.

In FIG. 14, the container 10 is placed on a flat surface P with the storage space 21 at the bottom. In this state, the container 10 contacts the flat surface P at two points, P1 and P2. Here, the region between the point of contact P1 with the flat surface P, and the point, of contact P2 with the flat surface P is referred to as first contact region A with the flat surface P.

In the present embodiment, the container 10 is shaped so that the center of gravity of the container 10 is vertically above the first contact region A (second placement surface) with the flat surface P when the container 10 is placed with the storage space 21 at the bottom (see FIG. 14). Specifically, the end portion P3 of the bottom portion 39 of the container 10 is within the first contact region A with the flat surface P when the container 10 is placed with the storage space 21 at the bottom (see FIG. 14).

Figure 15:
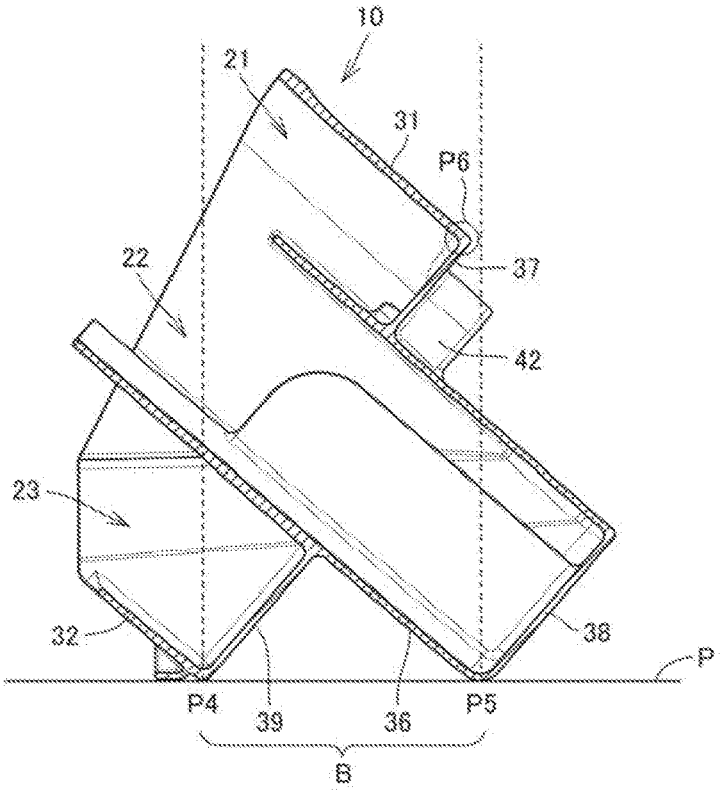
FIG. 15 is a side view schematically showing the container of FIG. 14 placed on a flat surface in a different fashion.

FIG. 15 shows a state in which the container 10 is placed on the flat surface P with the storage space 23 at the bottom. In this state, the container 10 contacts the flat surface P at two points, P4 and P5. Here, the region between the point of contact P4 with the flat surface P, and the point of contact P5 with the flat surface P is referred to second contact region B with the flat surface P.

In the present embodiment, the container 10 is shaped so that the center of gravity of the container 10 as vertically above the second contact region B (first placement surface) with the flat surface P when the container 10 is placed with the storage space 23 at the bottom (see FIG. 15). Specifically, the end portion P6 of the bottom portion 37 of the container 10 is within the second contact region B with the flat surface P when the container 10 is placed with the storage space 23 at the bottom (see FIG. 14).

Figure 16:
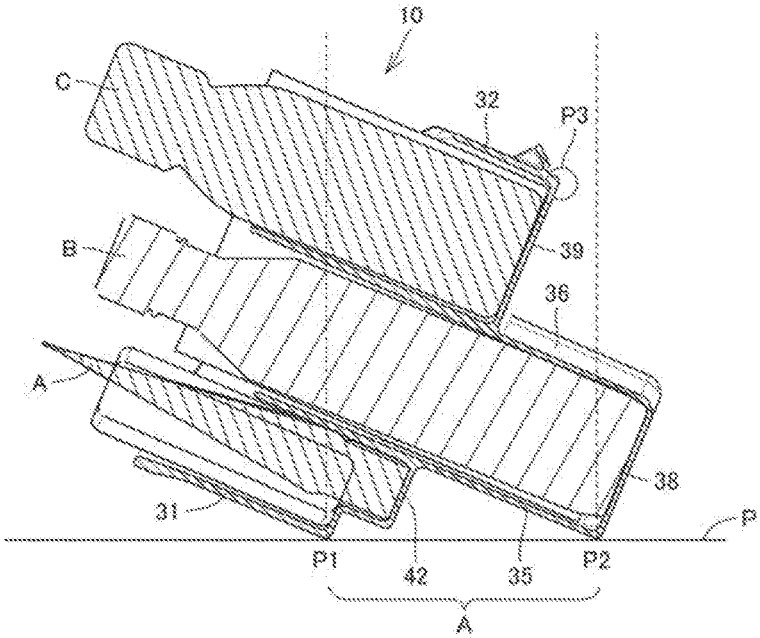
FIG. 16 is a schematic view showing the container of Second Embodiment placed on a flat surface in the same manner as in FIG. 14 but with articles stored therein.

As described above, because the container 10 shaped so that the center of gravity of the container 10 is within the first contact region A with the flat surface P, the container 10 can be stably held with the articles A, B, and C stored in the storage spaces 21, 22, and 23, as shown in FIG. 16.

Figure 17:
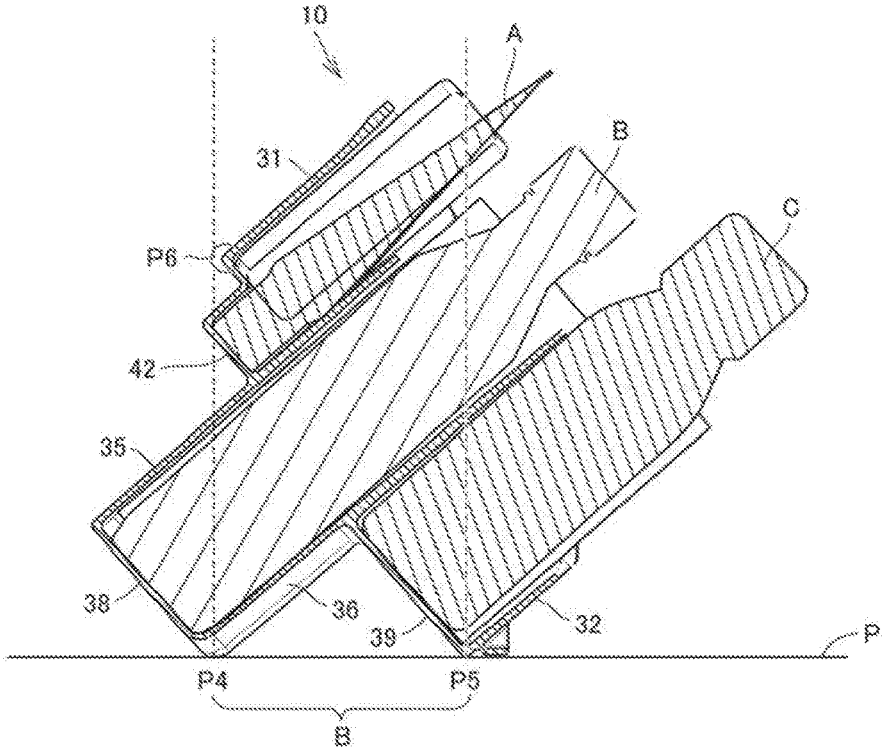
FIG. 17 is a schematic view showing the container of Second Embodiment placed on a flat surface in the same manner as in FIG. 15 but with articles stored therein.

Because the container 10 is shaped so that the center of gravity of the container 10 is within the second contact region B with the flat surface P, the container 10 can be stably held with the articles A, B, and C stored in the storage spaces 21, 22, and 23, as shown FIG. 17. When the container 10 is used by being installed on the refrigeration compartment door 11*a*, the container 10 is installed in such an orientation that the first placement surface contacts the inner wall surface of the refrigeration compartment door 11*a*.

In the present embodiment, as illustrated in FIG. 14, the storage spaces 21, 22, and 23 of the container 10 have a storage direction that is tilted with respect to the placement surface P. In this way, the stored articles in the storage spaces 21, 22, and 23 can be easily taken in and out of the container 10 placed on a flat surface.

As described above, the container 10 according to the present embodiment can be stably placed on a flat surface, regardless of whether the lower side is the storage space 21 or the storage space 23.

The container 10 of various different configurations such as those described above can be used to store articles of various sizes in the appropriate storage spaces, even when the container 10 is placed on a flat surface as in Second Embodiment. With the foregoing configuration, the container with plural rows of storage spaces can be placed upside down. This allows the container to be placed on various different places, for example, such as on a shelf inside the refrigeration compartment, a table outside of the refrigerator, and a cooking kitchen counter. That is, the container 10 according to the present embodiment has the versatility to adapt to various places.

When the container 10 is to be used only on a flat surface, it is not necessarily required to provide members such as the reinforcing ribs (reinforcing members) 41*a* and 41*b*, and the hooks 46.

It is to be noted, however, that the reinforcing ribs 41*a* and 41*b* may be provided even when the container 10 is used by being placed on a flat surface. In this case, the reinforcing ribs 41*a* and 41*b* have vertically extending surfaces projecting out from the both side surfaces (i.e., the left side portion 33, and the right side portion 34) of the container 10. With such reinforcing ribs 41*a* and 41*b*, the container 10 can be prevented from rolling on a flat surface. Preferably, the reinforcing ribs 41*a* and 41*b* are provided closer to the first placement surface (the second contact region B of FIG. 15) of the container.

In the container 10 according to the present embodiment, the storage spaces 21, 22, and 23 have different depths L1, L2, and L3. Specifically, in the container 10, the depth L2 of the storage space 22 of the middle row is the largest (see FIG. 7).

In the container 10 according to the present embodiment, as shown in FIG. 4, the widths Wa, Wb, and Wc between the outer edges of the storage spaces 21, 22, and 23 of the container 10 are related to one another by the following relationship.

$$Wa<Wb<Wc$$

Because the storage space 22 of the middle row is the deepest of the three rows of storage spaces 21, 22, and 23 in the container 10, the container 10 can be used by tilting the storage spaces with respect to the placement surface (see FIGS. 14 and 15). Because the width between the outer edges gradually becomes wider from the front row to the back row (Wa<Wb<Wc), the container can be placed in the orientation desired by a user. A user can also choose to decide which of the storage spaces 21, and 23 would be most suitable to store articles of various sizes.

For example, the container 10 may be placed with the front row (second placement surface) facing down when a user wants to put a smaller article closer to the user, or with the back row (first placement surface) facing down when a user wants to put more articles closer to the user. When the container 10 is placed with the first placement surface facing down, the container 10 lies on the storage space 23 of a wider width (width Wc). This improves the stability of the container 10, in addition to making the container 10 look more stable.

With regard to the widths (depths) W1, W2, and W3 of the storage spaces 21, 22, and 23 in depth direction (see FIG. 7), it is preferable that, for example, the depth W1 of the storage space 21 be smaller than the depths W2 and W3 of the other storage spaces. In this way, the storage space 21 of the front row can be designated specifically for the storage of smaller articles, whereas the storage space 23 of the back row can be reserved for larger articles.

It is preferable in the container 10 of the present embodiment that the tilt angle of the storage direction of the storage spaces be different when the container 10 is placed on a flat surface P lies on the storage space 21 (see FIG. 14), and when the container 10 is placed on a flat surface P lies on the storage space 23 (see FIG. 15).

For example, as shown in FIGS. 14 and 15, the tilt angle may be larger when the container 10 placed on a flat surface P lies on the storage space 23 than when the container 10 placed on a flat surface P lies on the storage space 21. That is, the storage direction of the storage spaces may have a larger tilt angle when the container 10 lies on the first placement surface (see FIG. 15) than when the container 10 lies on the second placement surface (see FIG. 14). This is because the width Wc of the storage space 23 is larger than the width Wa of the storage space 21, and allows the container 10 to be stably placed on a flat surface even when the tilt angle is large. With a large tilt angle, the center of gravity is less likely to shift forward, and the container does not easily fall even when a heavy article is stored in the storage space 23, as shown in FIG. 15.

On the other hand, an advantage of the state shown in FIG. 14 is that, because of the small tile angle, the container does not easily roll, though it is not as stable as when placed as shown in FIG. 15. In the state shown in FIG. 14, a user is likely to store a heavy article in the upper storage space 21. With a large tilt angle, the container may fall over backward when a heavy article is stored in the upper storage spaces. It is therefore preferable to make the tile angle smaller when the container 10 is placed as shown in FIG. 14. In this way, the container 10 can stably remain in the state shown in FIG. 14.

With the storage spaces sized and tilted in the manner described above, the articles can be stably stored regardless of the orientation of the container placed on a surface.

Variations of Container

Figure 18:
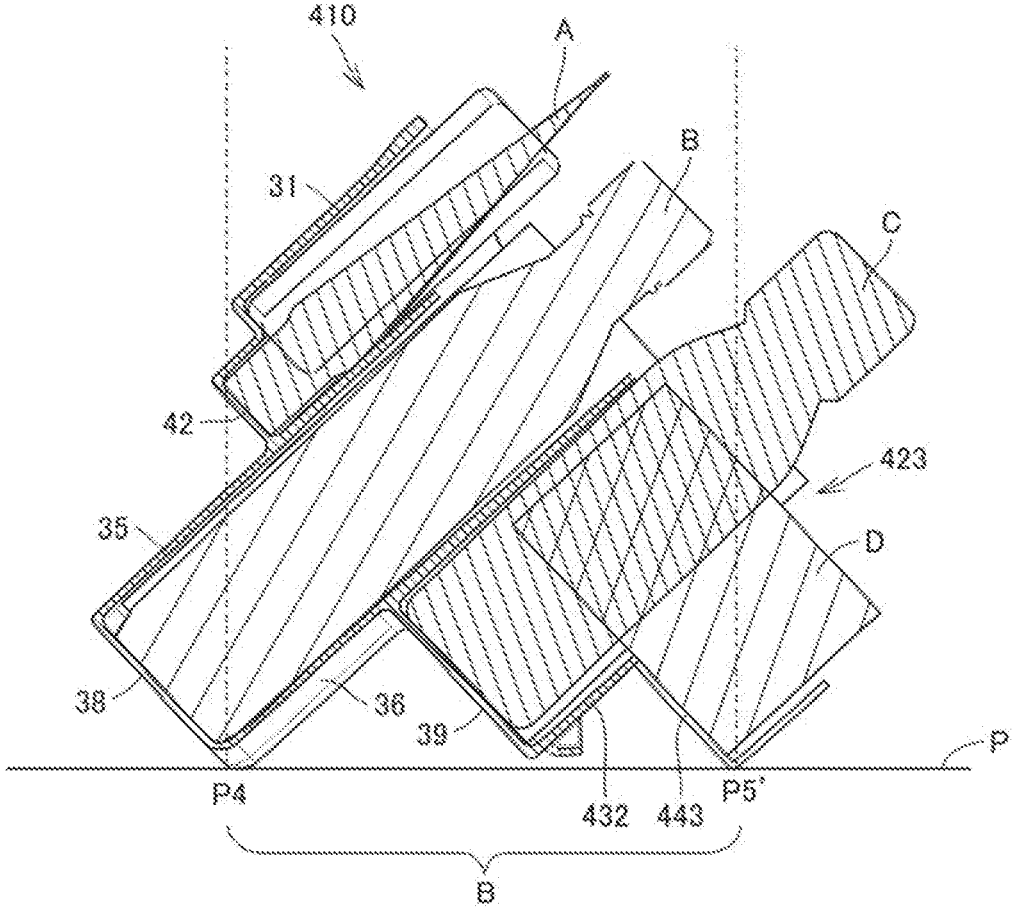
FIG. 18 is a schematic view showing a variation of the container according to Second Embodiment.

The following describes variations of the container 10. FIG. 18 is a cross sectional view of a container 410 according to a fourth variation. FIG. 18 shows the container 410 placed in the same manner as the container 10 shown in FIG. 17.

The container 410 differs from the container 10 in the shape of the storage space 423 of the rearmost row (the storage space 423 at the bottom). The other configuration is the same as in the container 10. As illustrated in FIG. 17, the container 410 has a protrusion 443 projecting out of the back portion 432 on the back side of the container.

The container 410 is in contact with a flat surface P at two points, P4 and P5'. As can be seen from a comparison of FIG. 17 and FIG. 18, the container 410 has a larger second contact region B.

Because of this, the container 410 can be more stably placed when it is placed with the storage space 423 facing down. With the configuration of the container 410, it is also possible to store a wider article D in the storage space 423.

Third Embodiment

Third Embodiment of the present invention is described below. Third Embodiment describes a configuration in which the container is used by being installed on a refrigeration compartment door, as in First Embodiment. The container according to Third Embodiment differs from First Embodiment in the configuration of the reinforcing ribs (reinforcing members). The other configuration may be the same as in First Embodiment. Accordingly, Third Embodiment specifically describes the configuration of the reinforcing ribs.

Figure 19:
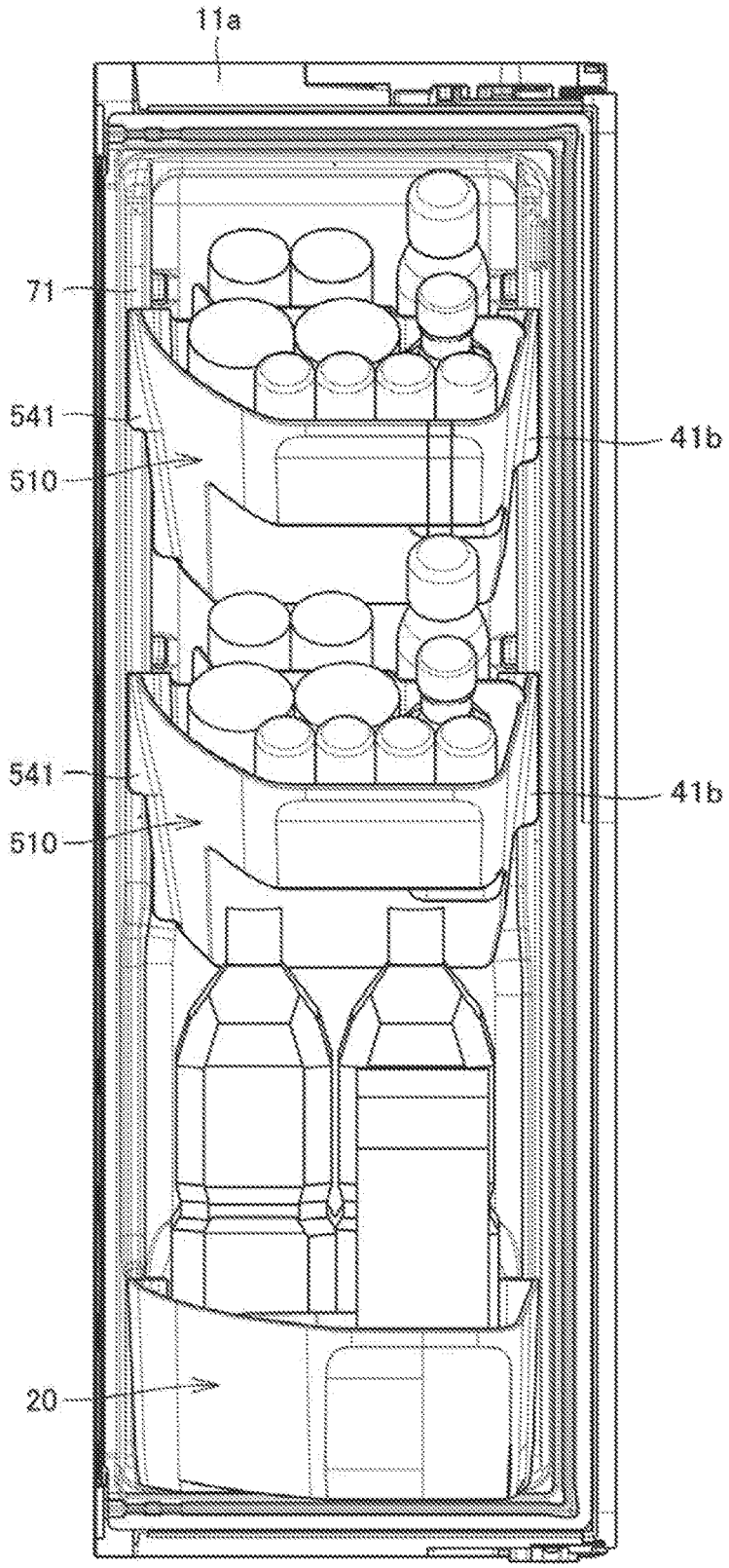
FIG. 19 is an elevational view showing the inner side of a refrigeration compartment door of a refrigerator according to Third Embodiment of the present invention.

FIG. 19 shows the inner side of a refrigeration compartment door 11*a* of a refrigerator according to Third Embodiment. As illustrated in FIG. 19, the refrigeration compartment door 11*a* has, from the top to bottom, a container 510, a container 510, and a large container 20 installed on the inner side (back surface) of the refrigeration compartment door 11*a*. The upper container 510 and the middle container 510 have the same configuration. The container 20 installed in the bottom stage has the same configuration as the container 20 of First Embodiment.

The container 510 has reinforcing ribs (reinforcing members) 541 and 41*b* on the left side portion 33 and the right side portion 34, respectively. The reinforcing ribs 541 and 41*b* are shaped so that these ribs contact the top of the side walls of the refrigeration compartment door 11*a* upon installing the container 10 on the refrigeration compartment door 11*a* (see FIG. 19).

The reinforcing rib 541 provided on the left side portion 33 extends more downwardly than the reinforcing rib 41*a* of First Embodiment. The reinforcing rib 41*b* provided on the right side portion 34 has the same configuration as the reinforcing rib 41*b* of First Embodiment. By the provision of the reinforcing ribs 541 and 41*b*, the container 10 can be more stably fixed to the refrigeration compartment door 11*a*.

Figure 20:
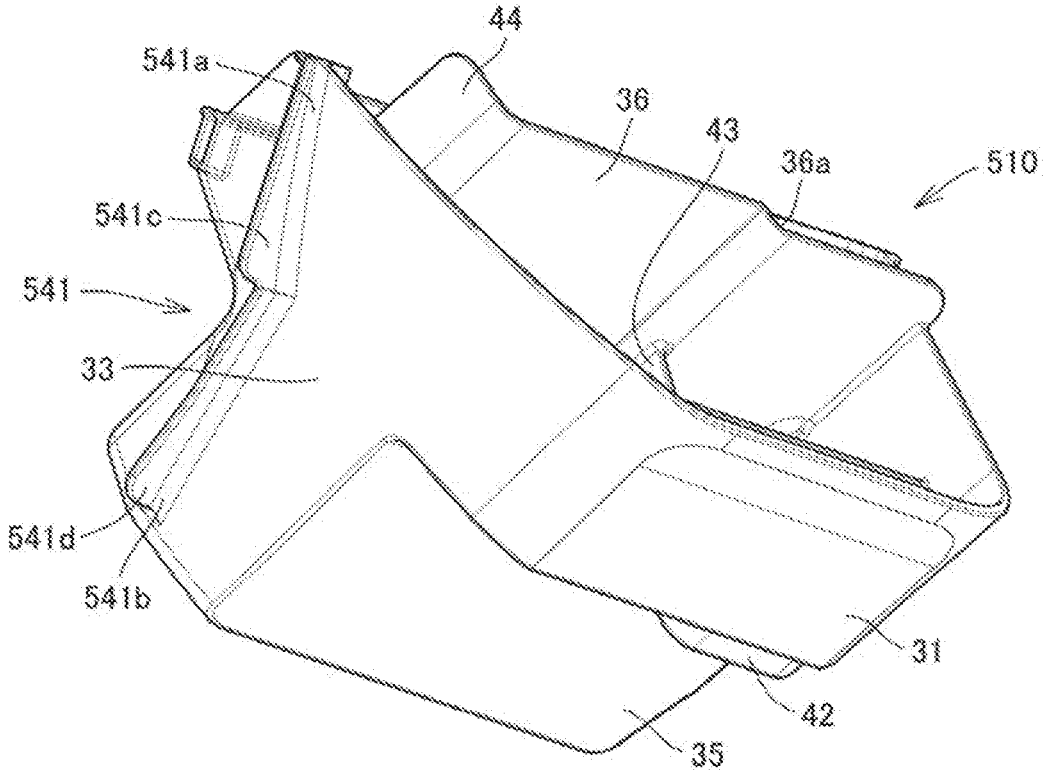
FIG. 20 is a perspective view showing a container installed on the refrigeration compartment door of the refrigerator shown in FIG. 19.

FIG. 20 shows a configuration on the left side portion 33 side of the container 510. As illustrated in FIG. 20, the reinforcing rib 541 extends from the upper end to the lower end of the left side portion. 33 of the container 510. The reinforcing rib 541 has a first erecting portion 541*a*, a second erecting portion. 541*b*, a first end portion 541*c*, and a second end portion 541*d*.

The first erecting portion 541*a* is provided at an upper portion of the left side portion 33. The first end portion 541*c* is a bent end portion of the first erecting portion 541*a*. The second erecting portion 541*b* is provided at a lower end portion of the left side portion 33. The second end portion 541*d* is a bent end portion of the second erecting portion 541*b*. The first erecting portion 541*a* and the first end portion 541*c* constituting an upper pardon of the reinforcing rib 541, and the second erecting portion 541*b* and the second end portion 541*d* constituting a lower portion of the reinforcing rib 541 are joined to each other with an angle.

When the container 510 of the configuration above is installed on the refrigeration compartment door 11*a*, the reinforcing rib 541 hides the gap between the container 510 and the side wall 71 of the open end side of the refrigeration compartment door 11*a*, as shown in FIG. 19. This makes the back surface of the refrigeration compartment door 111*a* less visible, and the refrigerator becomes cosmetically more appealing. Because the reinforcing rib 541 extends to the lower portion of the left side portion 33 of the container 510, the container 10 can be more stably fixed to the refrigeration compartment door 11*a*. The strength of the container 10 itself also can improve by the provision of the reinforcing rib 541.

Fourth Embodiment

Fourth Embodiment of the present invention is described below. Fourth Embodiment describes a configuration in which the container is used by being installed on a refrigeration compartment door, as in First Embodiment. Fourth Embodiment differs from First Embodiment in the configuration of the refrigeration compartment door (particularly, the configuration of the side walls). The container may have the same configuration as the container 10 of First Embodiment. Accordingly, Fourth Embodiment specifically describes the difference from First Embodiment, specifically, the configuration of the side walls of the refrigeration compartment door.

Figure 21:
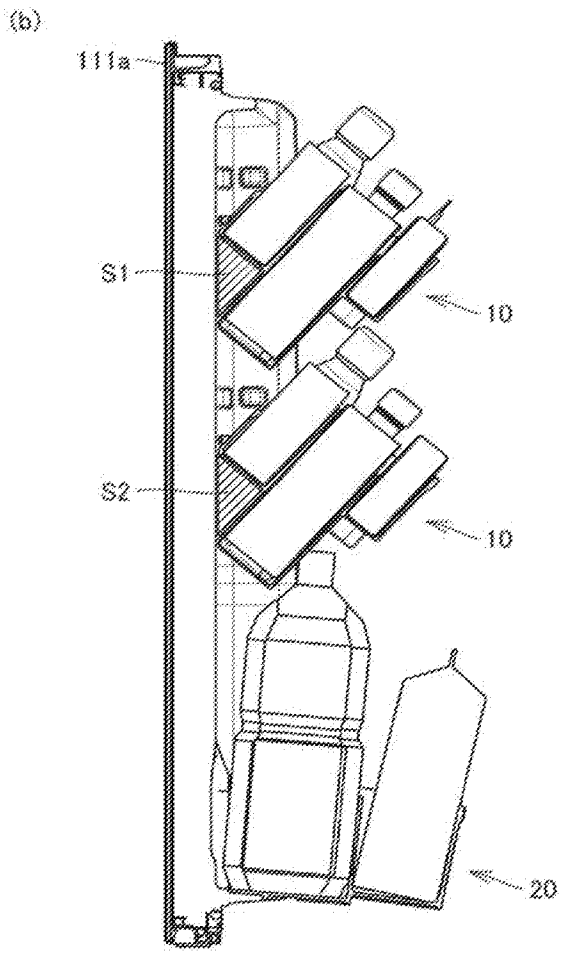
FIG. 21(*a*) is a perspective view showing a refrigeration compartment door of a refrigerator according to Fourth Embodiment of the present invention, and FIG. 21(*b*) is a cross sectional schematic view of the refrigeration compartment door shown in FIG. 21(*a*).
Figure 21:
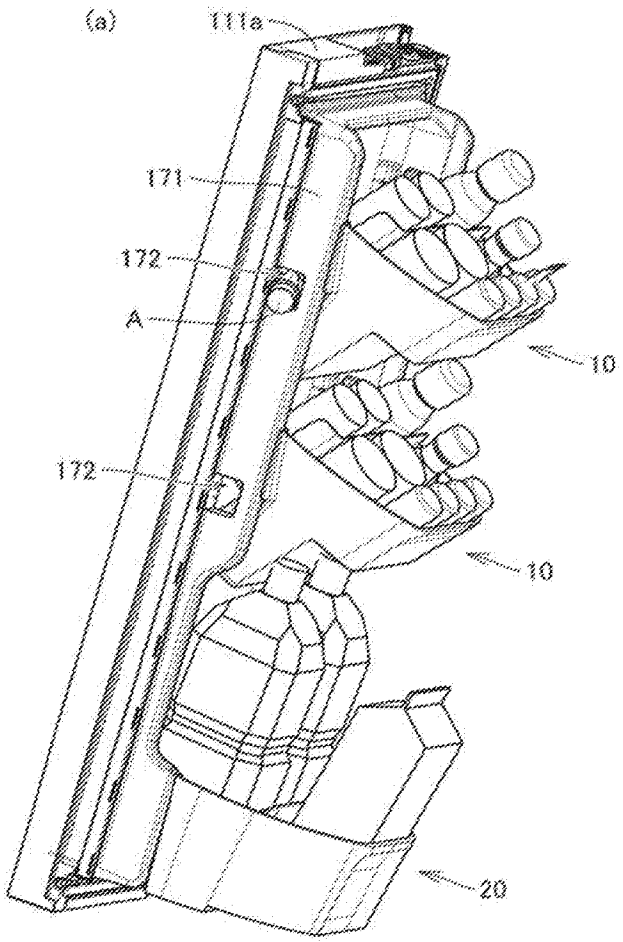

FIG. 21(*a*) shows a configuration on the open end side of a refrigeration compartment door 111*a* of a refrigerator according to Fourth Embodiment. FIG. 21 (*b*) shows a cross sectional configuration of the refrigeration compartment door 111*a*. The refrigeration compartment door 111*a* has, from the top to bottom, a container 10, a container 10, and a large container 20 installed on the inner side (back surface) of the refrigeration compartment door 111*a*. The containers 10 and 20 have the same configuration as the container 10 or 20 of First Embodiment.

The refrigeration compartment door 111*a* has side walls 171 near left and right end portions on the back surface of the refrigeration compartment door 111*a*. The side walls 171 project out of the back surface along the end portions. The containers 10 and 20 are fitted between the left and right, side walls.

The side wall 171 on the open end side of the refrigeration compartment door 111*a* has two openings 172. These openings 172 are formed in positions corresponding to spaces S1 and S2 created when the container 10 is installed on the refrigeration compartment door 111*a* (see FIG. 21 (*b*)). In this way, for example, a tube-like article A can be stored in the spaces S1 and S2 through the openings 172 (see FIG. 21 (*a*)).

As described above, the spaces S1 and S2, which would otherwise be a dead space, can be used as storage spaces in Fourth Embodiment. This makes it possible to increase the storage capacity of the refrigerator. The openings 172 provided through the side wall 171 may be notches formed by cutting the top of the side wall 171.

Fifth Embodiment

The foregoing First and Second Embodiments described examples in which the container of an aspect of the present invention is used in a refrigerator. However, the use of the container according to an aspect of the present invention is not limited to inside of a refrigerator. Fifth Embodiment describes an example in which the container is used in places other than a refrigerator.

The container 10 according to Fifth Embodiment may have the same container configurations described in First and Second Embodiments. The container 10 may be placed on a flat surface in the manner described in Second Embodiment. The container 10 may be placed on, for example, a kitchen cooking counter, a table, or a desk. Whether to place the container 10 on the side of the storage space 21 of the frontmost row or the storage space 23 of the rearmost row may be appropriately decided according to such factors as the location where the container 10 is placed, and the use of the container 10.

The embodiments disclosed herein are to be considered in all aspects only as illustrative and not restrictive. The scope of the present invention is to be determined by the scope of the appended claims, not by the foregoing descriptions, and the invention is intended to cover all modifications falling within the equivalent meaning and scope of the scope of the claims set forth below. A configuration based on a combination of different configurations of the embodiments described in this specification is also intended to fall within the scope of the present invention.

REFERENCE SIGNS LIST

1: Refrigerator
10: Container

11: Refrigeration compartment
11*a*: Refrigeration compartment door
21: Storage space (of the frontmost row)
22: Storage space (of the middle row)
23: Storage space (of the rearmost row)
33: Left side portion (side portion)
34: Right side portion
35: First partition wall
36: Second partition wall
36*a*: Stepped portion
41*a*: Reinforcing (reinforcing member)
41*b*: Reinforcing rib (reinforcing member)
44: End portion (of second partition wall)
45*a*: Protrusion
46: Hook (engaging portion)
71: Side wall
Space: S1

The invention claimed is:

1. A container comprising three storage spaces arranged in rows, the three storage spaces including a first row which is a frontmost row, a second row which is a middle row, and a third row which is a rearmost row, wherein the first row is shallower than at least one of the second and third rows, the second row is the deepest of the three storage spaces, and wherein when the container is placed on a horizontal surface, a storage direction of the storage spaces is tilted with respect to the horizontal surface, the container has a center of gravity vertically above a first contact region that contacts the horizontal surface when the container is placed on the horizontal surface with the storage space of the third row closest to the horizontal surface, and the container has a center of gravity vertically above a second contact region that contacts the horizontal surface when the container is placed on the horizontal surface with the storage space of the first row closest to the horizontal surface.

2. The container according to claim 1, wherein a width between outer edges of the first row is smaller than a width between outer edges of the second row and a width between outer edges of the third row.

3. The container according to claim 1, wherein a tilt angle of the storage direction of the storage spaces is larger when the container lies on the first contact region than when the container lies on the second contact region.

4. The container according to claim 1, which comprises reinforcing ribs having vertically extending surfaces projecting out from both side surfaces of the container.

5. The container according to claim 1, which comprises partition walls between the storage spaces, at least one of the partition walls having a step.

6. The container according to claim 1, which is installable on an inner wall surface of a door of a storage.

7. The container according to claim 6, wherein the storage space of the third row on a side opposite a hinged side of the door is separated from outer edges surrounding the three storage spaces.

8. The container according to claim 6, wherein the three storage spaces are disposed in a depth direction and tilt forward and upward when the container is installed on the door, the storage space of the first row being narrower in the depth direction than at least one of the storage spaces of the second and third rows.

9. The container according to claim 8, wherein a side wall that projects out toward a storage chamber is provided on at least an open end side on an inner side of the door, and wherein the container further includes engaging portions that engage stoppers provided on the door, and reinforcing members that are provided in front of the engaging portions and that contact the side walls when the container is installed on the door.

10. The container according to claim 9, wherein the engaging portions are disposed behind both side surfaces of the container, and wherein the container includes a protrusion formed on a back portion of the container to join the engaging portions disposed on the both side surfaces of the container.

11. The container according to claim 8, wherein a partition wall is disposed between adjacent storage spaces in the plurality of storage spaces, and wherein an end of the partition wall is separated from a side portion on an open end side of the door.

12. The container according to claim 8, wherein a partition wall is disposed between the storage space of the rearmost third row and the storage space of the second row, and wherein the partition wall on an open end side of the door has a bent end portion that is bent toward the third row.

13. A refrigerator comprising:

a refrigeration compartment; and a door installed on the refrigeration compartment, wherein the container of claim 1 is installed on an inner side of the door.

* * * * *